US011401883B2

(12) United States Patent
Styron

(10) Patent No.: US 11,401,883 B2
(45) Date of Patent: Aug. 2, 2022

(54) SYSTEM AND METHOD FOR DIRECT INJECTION FUEL PUMP CONTROL

(71) Applicant: Ford Global Technologies, LLC, Dearborn, MI (US)

(72) Inventor: Joshua Putman Styron, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 50 days.

(21) Appl. No.: 16/839,398

(22) Filed: Apr. 3, 2020

(65) Prior Publication Data

US 2021/0310437 A1 Oct. 7, 2021

(51) Int. Cl.
*F02D 41/38* (2006.01)
*F02D 1/00* (2006.01)

(52) U.S. Cl.
CPC .... *F02D 41/3845* (2013.01); *F02D 2001/009* (2013.01); *F02D 2041/389* (2013.01); *F02D 2200/101* (2013.01)

(58) Field of Classification Search
CPC ..... F02D 41/3845; F02D 2001/009; F02D 2041/389; F02D 2200/101
See application file for complete search history.

(56) References Cited

U.S. PATENT DOCUMENTS 3,856,438 A * 12/1974 Simko ..... F04B 49/225 417/270
5,345,916 A * 9/1994 Amann ..... F02M 41/1411 123/450
5,647,326 A * 7/1997 Kato ..... F02M 59/265 123/500
5,888,054 A 3/1999 Djordjevic
6,336,445 B1 1/2002 Yamazaki et al.
6,668,800 B2 12/2003 Ricco et al.
6,694,952 B1 * 2/2004 Yamazaki ..... F04B 9/042 123/496
7,552,720 B2 6/2009 Borg et al.
8,286,546 B2 * 10/2012 Rastelli ..... F02M 59/02 92/129
10,788,025 B2 * 9/2020 Ishikura ..... F02M 59/027
2017/0276125 A1 * 9/2017 Ishikura ..... F02M 59/027

FOREIGN PATENT DOCUMENTS

| | | | |
|---|---|---|---|
| DE | 102015002733 | A1 | 9/2016 |
| DE | 102015105735 | A1 | 10/2016 |
| EP | 1655480 | B1 | 6/2008 |
| EP | 2414675 | B1 | 1/2019 |
| JP | H10274075 | A | 10/1998 |
| WO | 2005111406 | A1 | 11/2005 |
| WO | 2010112253 | A1 | 10/2010 |

* cited by examiner

*Primary Examiner* — Carl C Staubach
(74) *Attorney, Agent, or Firm* — Vincent Mastrogiacomo; McCoy Russell LLP

(57) ABSTRACT

Methods and systems are provided for vehicle direct injection fuel pump control. In one example, a method may include reducing a flow speed of fuel from a cam-driven direct injection fuel pump for at least half of a total duration of an output stroke of the fuel pump. A cam driving the fuel pump may reduce the flow speed at a first rate during a main portion of the output stroke, and the cam may reduce the flow speed at a second rate during an end ramp portion of the output stroke.

9 Claims, 11 Drawing Sheets

SYSTEM AND METHOD FOR DIRECT INJECTION FUEL PUMP CONTROL

FIELD

The present description relates generally to methods and systems for vehicle direct injection fuel pump control.

BACKGROUND/SUMMARY

Some vehicle engine systems utilize gasoline direct injection (GDI) to increase power efficiency and range over which the fuel can be delivered to the cylinder. GDI fuel injectors may demand fuel at higher pressure for direct injection to create enhanced atomization providing more efficient combustion. In one example, a GDI system can utilize an electrically driven lower pressure pump (also termed a fuel lift pump) and a mechanically driven higher pressure pump (also termed a direct injection fuel pump) arranged respectively in series between the fuel tank and the fuel injectors along a fuel passage. In many GDI applications the higher pressure fuel pump may be used to increase the pressure of fuel delivered to the fuel injectors. The higher pressure fuel pump may include a solenoid valve that may be controlled to control the flow of fuel into and out of the higher pressure fuel pump.

Various control strategies exist for operating the higher pressure pump to ensure efficient fuel system and engine operation. Often, direct injection fuel pumps are configured to provide fuel a same high velocity to the engine for various different engine operating conditions, such as during conditions of high engine load and during conditions of low engine load. For such fuel pumps, the fuel velocity is often relatively constant for a large portion of each output stroke of the pump, such that fuel is delivered to the engine at a relatively constant rate for each output stroke.

However, the inventors herein have recognized potential issues with the above strategy. As an example, delivering fuel to the engine at the same high velocity for both higher and lower engine load may result in excessive noise at lower engine load and during conditions of lower fuel demand. The constant fuel velocity may result in a same amount of noise generated by the fuel pump for different engine load, and at lower engine load, the amount of noise generated by the fuel pump may be a relatively large portion of an overall amount of noise produced by the engine.

In one example, the issues described above may be addressed by a method, comprising: during an output stroke of a cam-driven direct injection fuel pump of an engine, maintaining a drive speed of the cam-driven direct injection fuel pump while continuously reducing a flow speed of a total flow of fuel from the cam-driven direct injection fuel pump for at least half of a total duration of the output stroke. In this way, an amount of noise resulting from fuel pump operation at different engine loads may be reduced.

As one example, the fuel pump includes a plunger driven through the output stroke of the fuel pump, including a main portion and an end ramp portion. The speed of the plunger and the total flow of fuel from the fuel pump may be reduced at a first constant rate during the main portion, and the speed of the plunger and the total flow of fuel may be reduced at a second constant rate during the end ramp portion. An energization timing of the fuel pump solenoid may be adjusted to control the quantity of fuel delivered to the engine. For lower load (smaller fuel quantities), the energization time may occur later in the output (pumping) stroke. If the speed of the plunger is reduced when this solenoid closes to direct fuel to the engine, noise associated with operation of the fuel pump may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
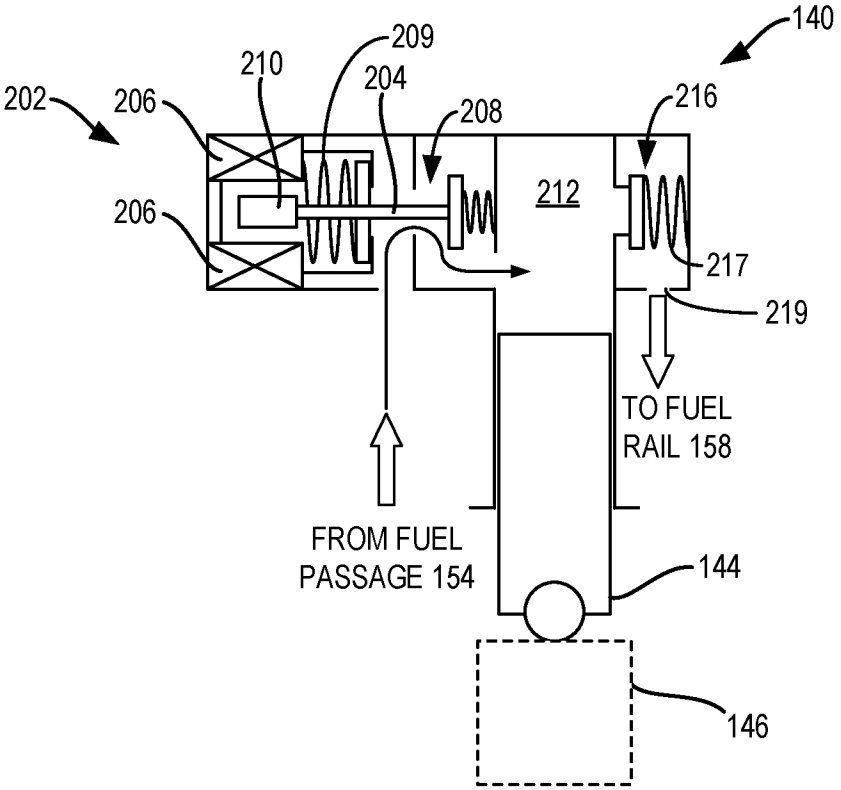
FIG. 2 shows a schematic diagram of a solenoid valve of a direct injection fuel pump of a vehicle fuel system.
Figure 3:
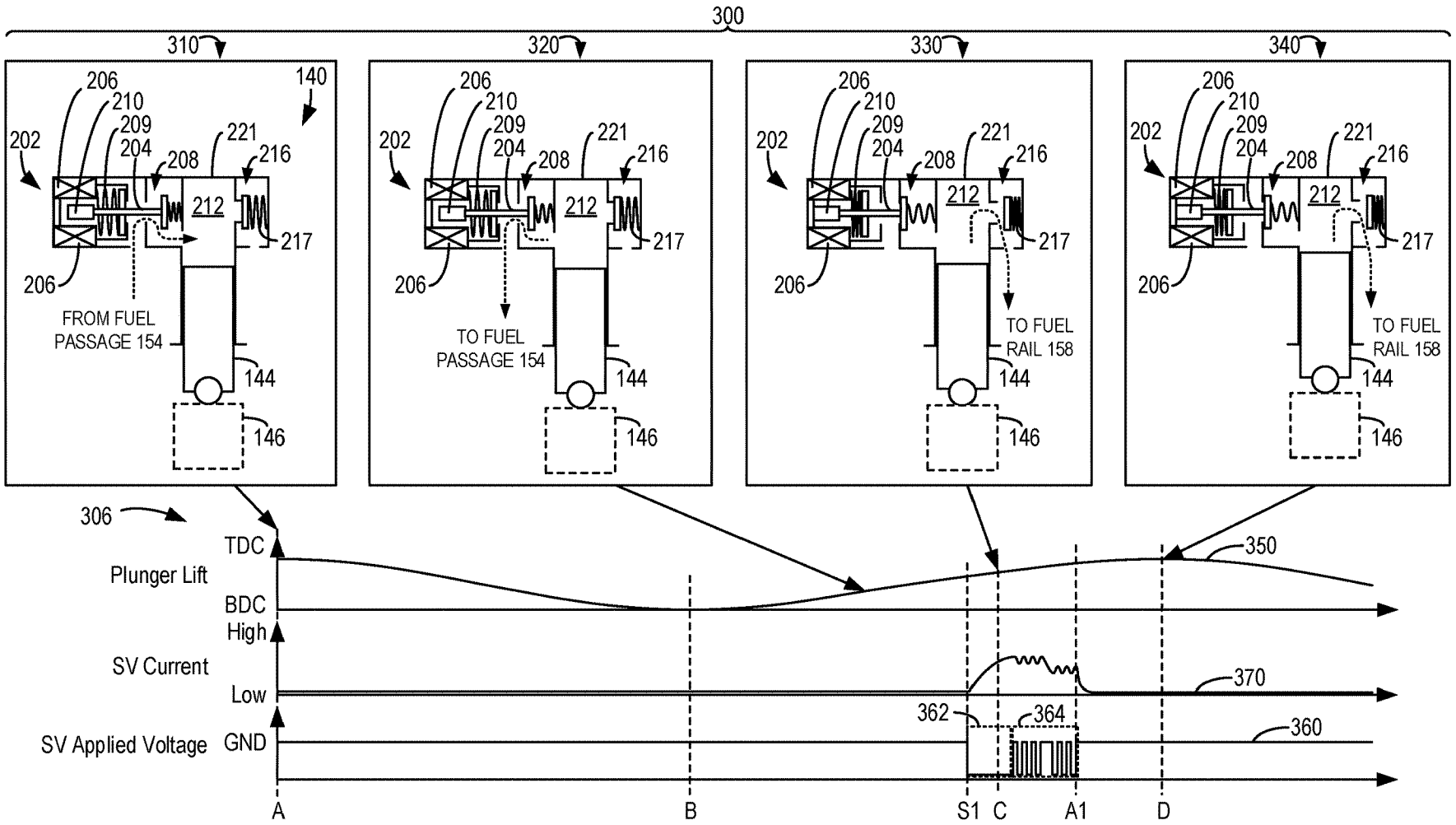
FIG. 3 shows a control strategy for a direct injection fuel pump of a vehicle fuel system.
Figure 4:
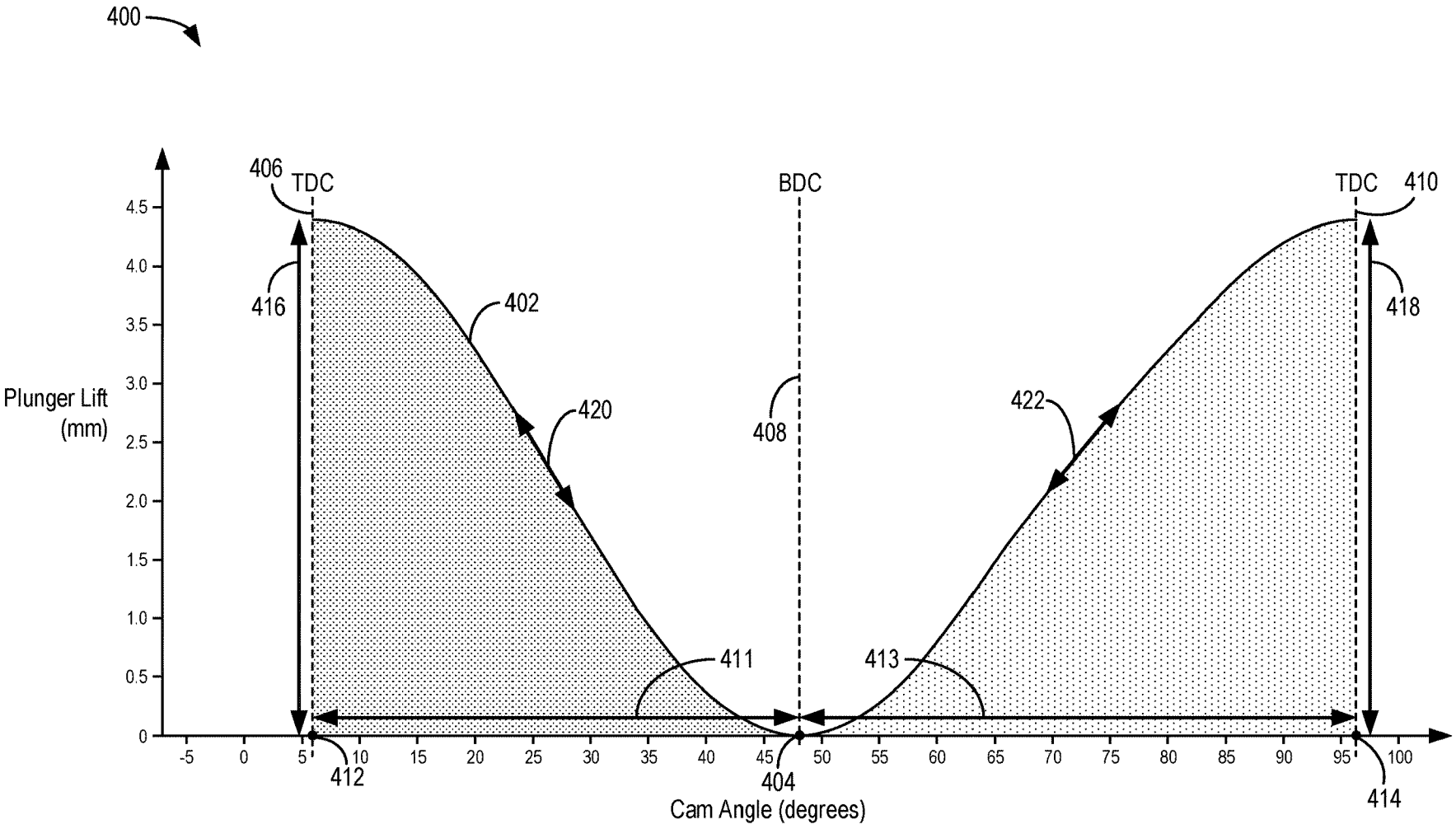
FIG. 4 shows a chart with a plot illustrating a plunger lift amount versus cam angle relationship for a cam of a direct injection fuel pump of a vehicle fuel system.
Figure 5:
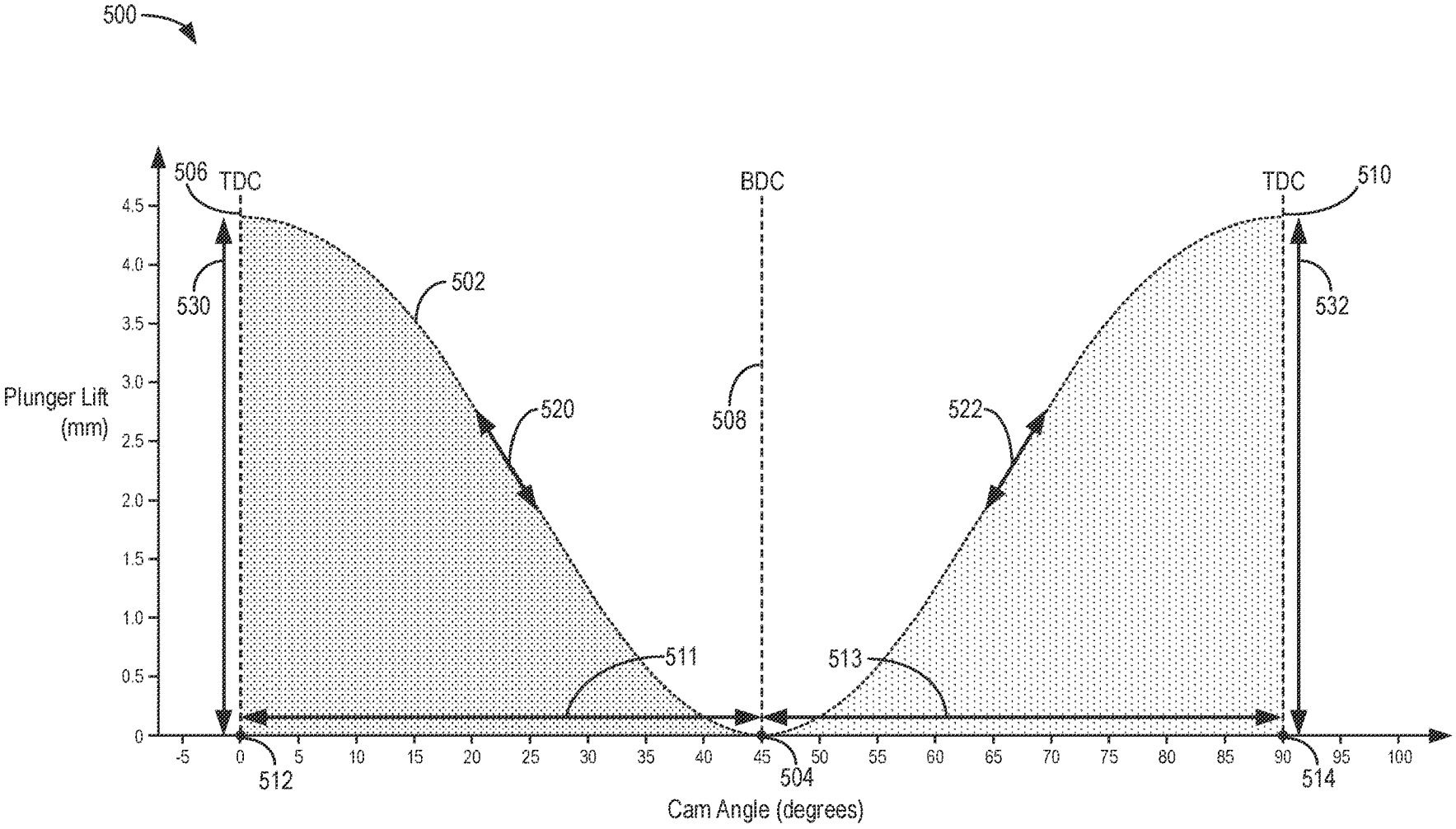
FIG. 5 (Prior Art)
FIG. 5 shows a chart with a plot illustrating a conventional plunger lift amount versus cam angle relationship of a direct injection fuel pump.
Figure 6:
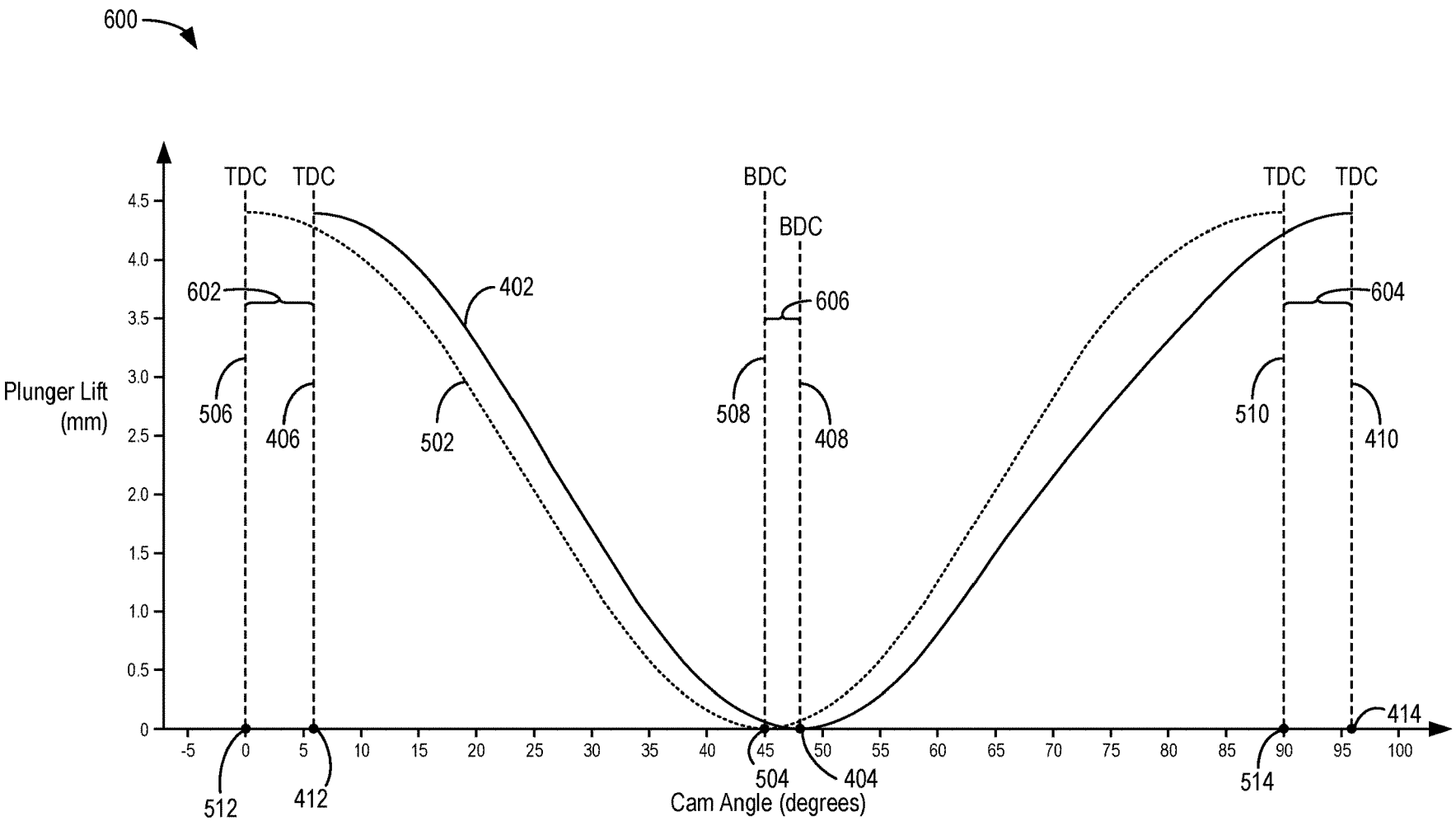
FIG. 6 shows a chart including the plots of FIGS. 4-5.
Figure 7:
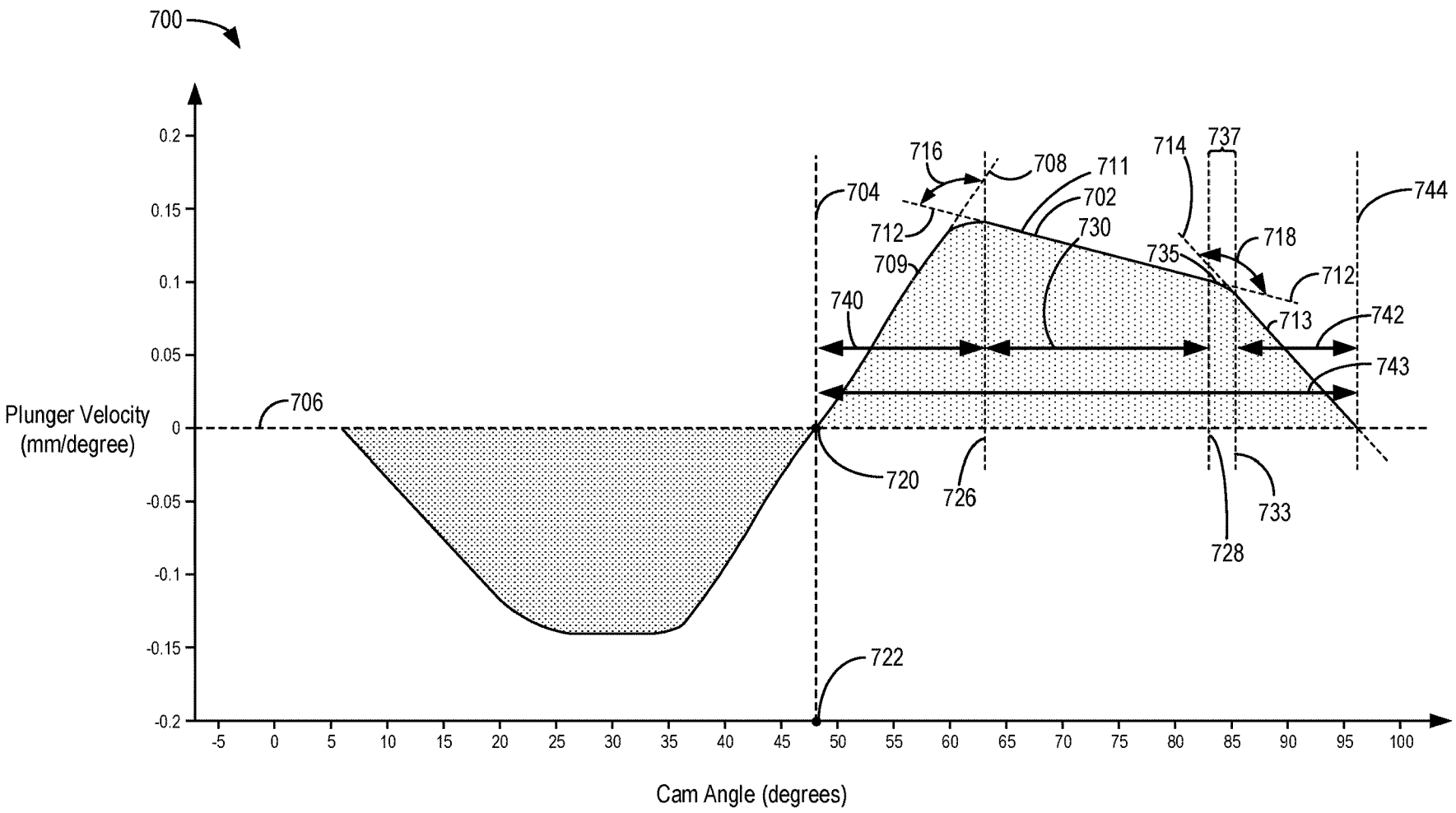
FIG. 7 shows a chart with a plot illustrating a velocity of the plunger of the direct injection fuel pump driven by the cam having the plunger lift amount versus cam angle relationship of FIG. 4.
Figure 8:
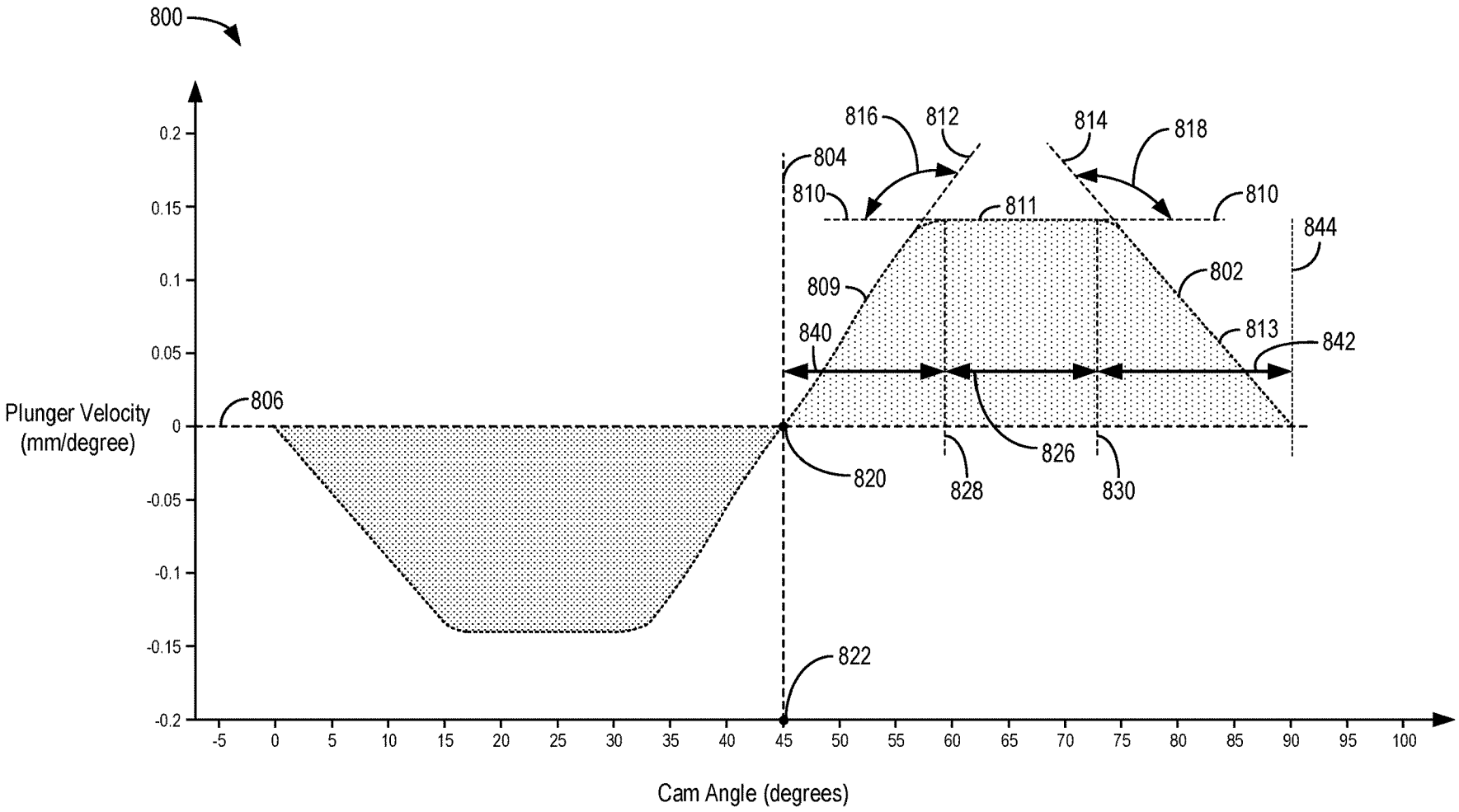
FIG. 8 shows a chart with a plot illustrating a velocity of the plunger of the direct injection fuel pump driven by the cam having the conventional plunger lift amount versus cam angle relationship of FIG. 5.
Figure 9:
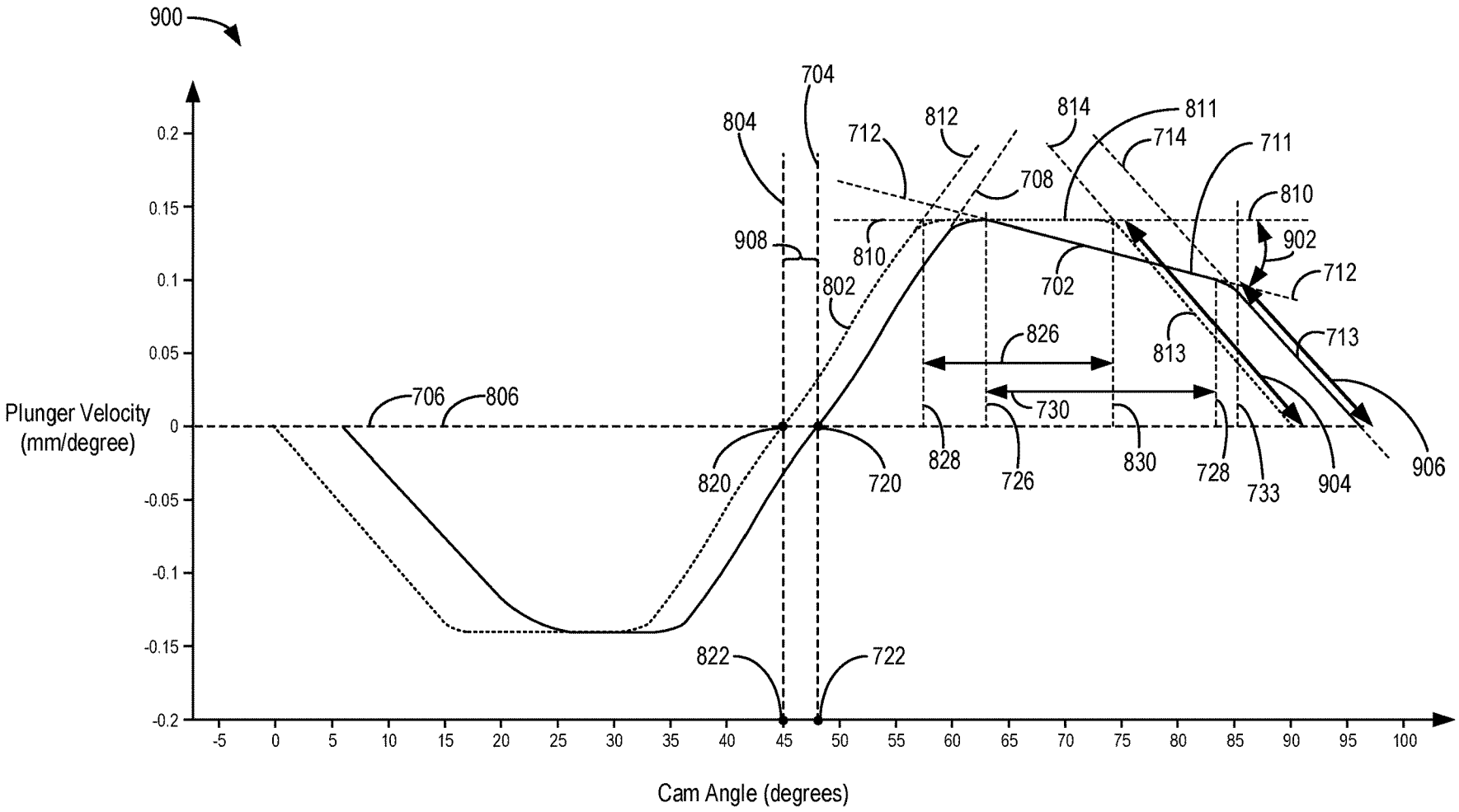
FIG. 9 shows a chart including the plots of FIGS. 7-8.
Figure 10:
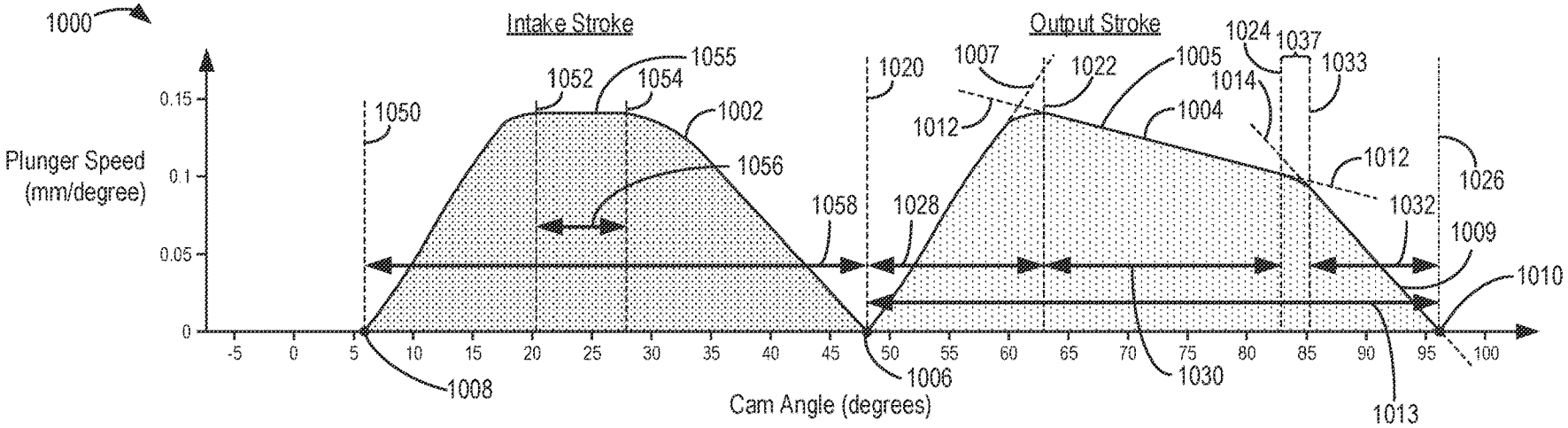
FIG. 10 shows a chart with a plot illustrating plunger speed versus cam angle for the direct injection fuel pump driven by the cam having the plunger lift amount versus cam angle relationship of FIG. 4.
Figure 11:
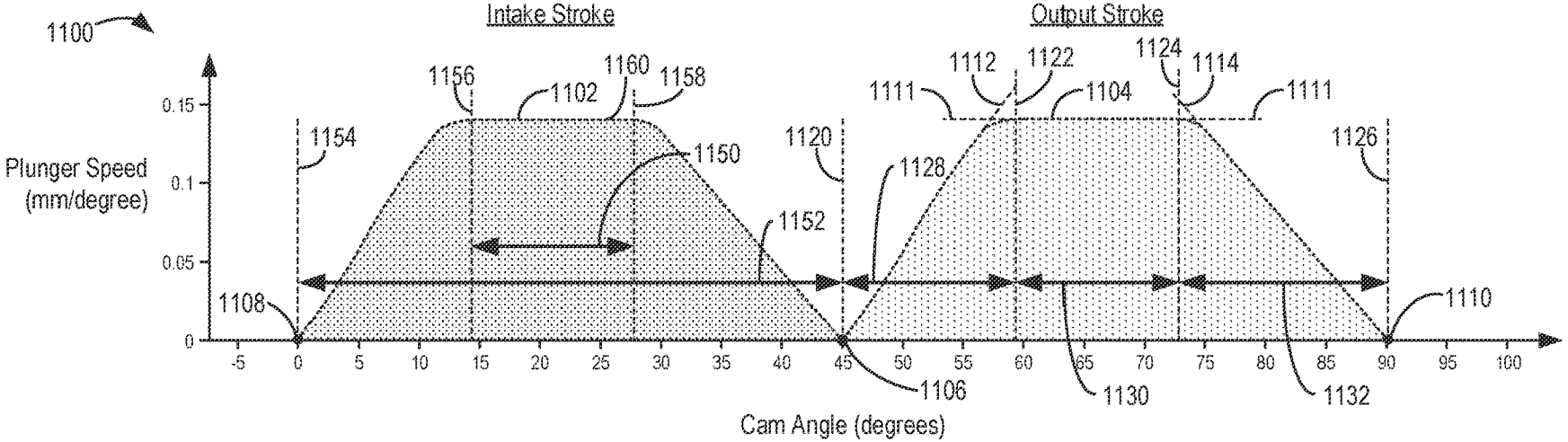
FIG. 11 (Prior Art)
FIG. 11 shows a chart with a plot illustrating plunger speed versus cam angle for the direct injection fuel pump driven by the cam having the conventional plunger lift amount versus cam angle relationship of FIG. 5.
Figure 12:
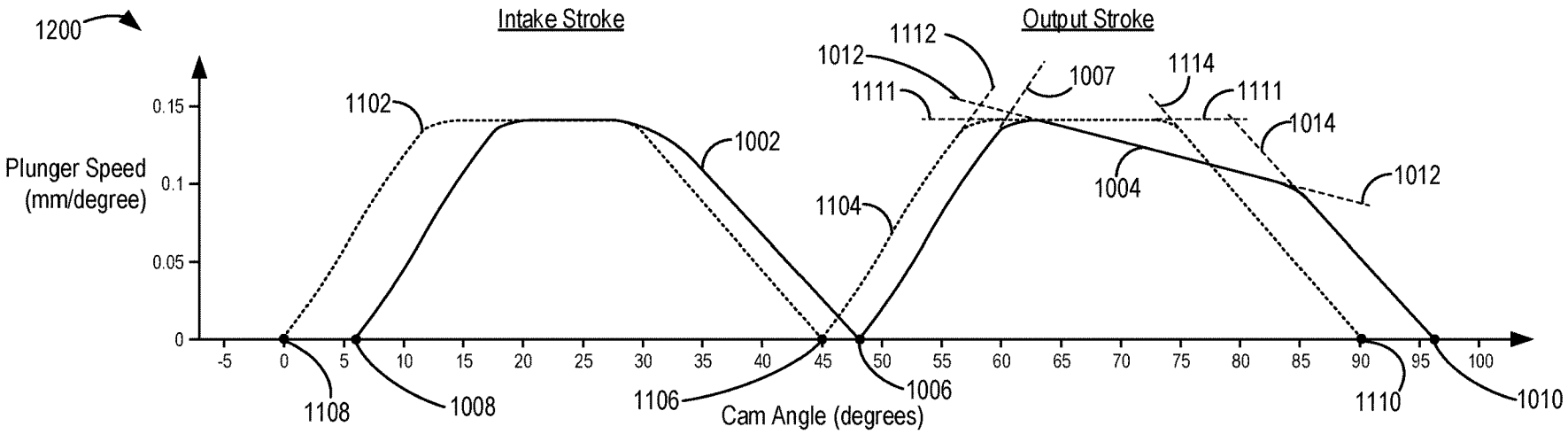
FIG. 12 shows a chart including the plots of FIGS. 10-11.

The following description relates to systems and methods for vehicle direct injection fuel pump control. A fuel system of an engine of a vehicle, such as the fuel system shown by FIG. 1, includes a cam-driven direct injection fuel pump. The fuel pump includes a solenoid valve and is configured to pump fuel from a fuel passage to a fuel rail of the fuel system, as shown by FIG. 2. The solenoid valve may be energized or de-energized while a plunger of the fuel pump is driven by the cam to pump fuel from the fuel passage to the fuel rail, as shown by FIG. 3. Conventionally, a cam of a direct injection fuel pump may drive a plunger of the pump through an intake stroke and an output stroke, with a lift profile of the intake stroke being symmetrical to a lift profile of the output stroke, as shown by FIG. 5. However, according to the present disclosure, a cam is configured to drive a plunger of a direct injection fuel pump through an intake stroke and an output stroke, with a lift profile of the plunger during the output stroke being asymmetrical relative to a lift profile of the plunger during the intake stroke, as shown by FIGS. 4 and 6. Further, a velocity of the plunger of the fuel pump driven by the cam according to the present disclosure decreases at a constant rate during a main portion of the output stroke, as illustrated by FIGS. 7 and 9, whereas the velocity of the plunger of the conventional example does not decrease at the constant rate, as illustrated by FIG. 8. Because the velocity of the plunger decreases at the constant rate during the main portion, a corresponding speed of the plunger also decreases at the constant rate during the main portion according to the present disclosure (as illustrated by FIGS. 10 and 12), whereas a speed of the plunger of the conventional example does not decrease at the constant rate (as illustrated by FIG. 11). By configuring the direct injection fuel pump according to the present disclosure, a noise, vibration, and/or harshness (NVH) of the engine may be decreased at lower engine loads by providing a lower speed and velocity of the plunger at the moment energization of the solenoid of the fuel pump occurs.

Conventional high-pressure fuel injection systems for direct injection engines often generate noise. A portion of the noise may occur as a result of abrupt changes to internal fuel pressure as the direct injection fuel pump transitions from returning fuel to the low pressure supply to supplying fuel to the high-pressure fuel rail. Fuel pressures within the direct injection fuel pump may increase rapidly from the lower inlet pressure to the higher outlet pressure during this transition. Because direct injection fuel pumps are conventionally include a plunger that travels at a relatively constant velocity for a large portion of each output stroke of the pump, noise resulting from operation of the pump may be high even for different amounts of engine load (e.g., different engine speeds or amounts of engine torque demand). For example, the plunger of a conventional direct injection fuel pump may have a same velocity at the moment the fuel pump transitions from returning fuel to the low pressure supply to supplying fuel to the high-pressure fuel rail for both lower engine speeds and higher engine speeds, and at the lower engine speeds, noise generated by the transition may be more noticeable.

However, the systems of the present disclosure are configured to provide direct injection with reduced NVH at lower engine loads via decreased plunger velocity at the moment the fuel pump transitions from returning fuel to the low pressure supply to supplying fuel to the high-pressure fuel rail. The cam configured to drive the plunger of the direct injection fuel pump reduces the velocity of the plunger for a range of cam rotation, where the transition to delivering fuel to the fuel rail occurs while the cam rotates through the range. As a result, noise generated by the pump is reduced, particularly at lower engine speeds (e.g., idling and/or cruising speeds).

The direct injection (DI) fuel pumps described herein may be piston pumps (e.g., plunger pumps) configured to output an amount of fuel corresponding to portion of their full displacement volume for each cycle including an intake stroke and output stroke. A solenoid valve may be energized according to an angular position of a cam configured to drive the fuel pump to control the volume of fuel pumped by the fuel pump. The solenoid valve may be de-energized at certain angular positions of the cam to reduce electrical energy consumption and heat generation. As described herein, the phrase "intake stroke" refers to a rotational range of the cam wherein the plunger of the direct injection fuel pump is driven in an outward direction from a pressure chamber of the pump such that fuel may flow into the pump via a lower pressure inlet source (e.g., a fuel passage fluidly coupled to a low-pressure fuel pump disposed within a fuel tank). The phrase "output stroke" refers to a rotational range of the cam wherein the plunger is driven in an inward direction to the pressure chamber, which may result in a flow of fuel from the direct injection fuel pump to a higher pressure outlet (e.g., a fuel rail) depending on an energization timing of the solenoid valve of the pump. However, it should be understood that the flow of fuel from the direct injection fuel pump to the higher pressure outlet may not occur through an entirety of the output stroke and instead may occur through only a portion of the output stroke. For example, at lower engine speeds, energization of the solenoid valve may occur with a different timing (e.g., a different rotational position of the cam during the output stroke) relative to a timing of energization of the solenoid valve at higher engine speeds, as will be elaborated further below.

The cam driving the direct injection (DI) fuel pump described herein (which may be referred to herein as a high pressure fuel pump, or HPFP) may be coupled to a camshaft of the engine, with the camshaft driven (e.g., rotated) by the engine to rotate the cam. The cam may be engaged with a plunger of the HPFP, and the rotation of the cam may drive (e.g., lift) the plunger within the fuel pump (e.g., adjust a position of the plunger within the fuel pump). In some examples the cam may include a plurality of lobes, such as three lobes, four lobes, etc. By controlling the output of the HPFP, the DI rail pressure may be controlled to target pressures ranging from a supply pressure (e.g., 55-90 psi) of a low pressure fuel pump arranged upstream of the direct injection fuel pump to a higher system pressure (e.g., 2900 psi or more). The output of the HPFP is controlled by diverting the displaced volume of each pump stroke to either the DI fuel rail or to the fuel supply line (e.g., the line supplying fuel to the direct injection fuel pump from the low pressure fuel pump). During conditions in which the DI rail pressure is less than the fuel supply line pressure, the HPFP may function as a one-way valve to reduce a likelihood of fuel flowing from the DI rail to the fuel supply line.

Regarding terminology used throughout this detailed description, a higher-pressure fuel pump, or direct injection fuel pump, that provides pressurized fuel to direct fuel injectors may be abbreviated as a DI or HP pump. Similarly, a lower-pressure pump (providing fuel pressure generally lower than that of the DI fuel pump), or lift pump, that provides pressurized fuel from a fuel tank to the DI fuel pump may be abbreviated as an LP pump. A solenoid actuated spill valve, which may be electronically energized to close and de-energized to open (or vice versa), may also be referred to as a solenoid valve (SV), spill valve, a fuel volume regulator, magnetic solenoid valve (MSV), solenoid actuated check valve (SACV), and a digital inlet valve, among other names. Depending on when the solenoid valve is energized during operation of the DI fuel pump, an amount of fuel may be trapped and compressed by the DI fuel pump during an output stroke, wherein the amount of fuel may be referred to as fractional trapping volume if expressed as a fraction or decimal, fuel volume displacement, or pumped fuel mass, among other terms.

Figure 1:
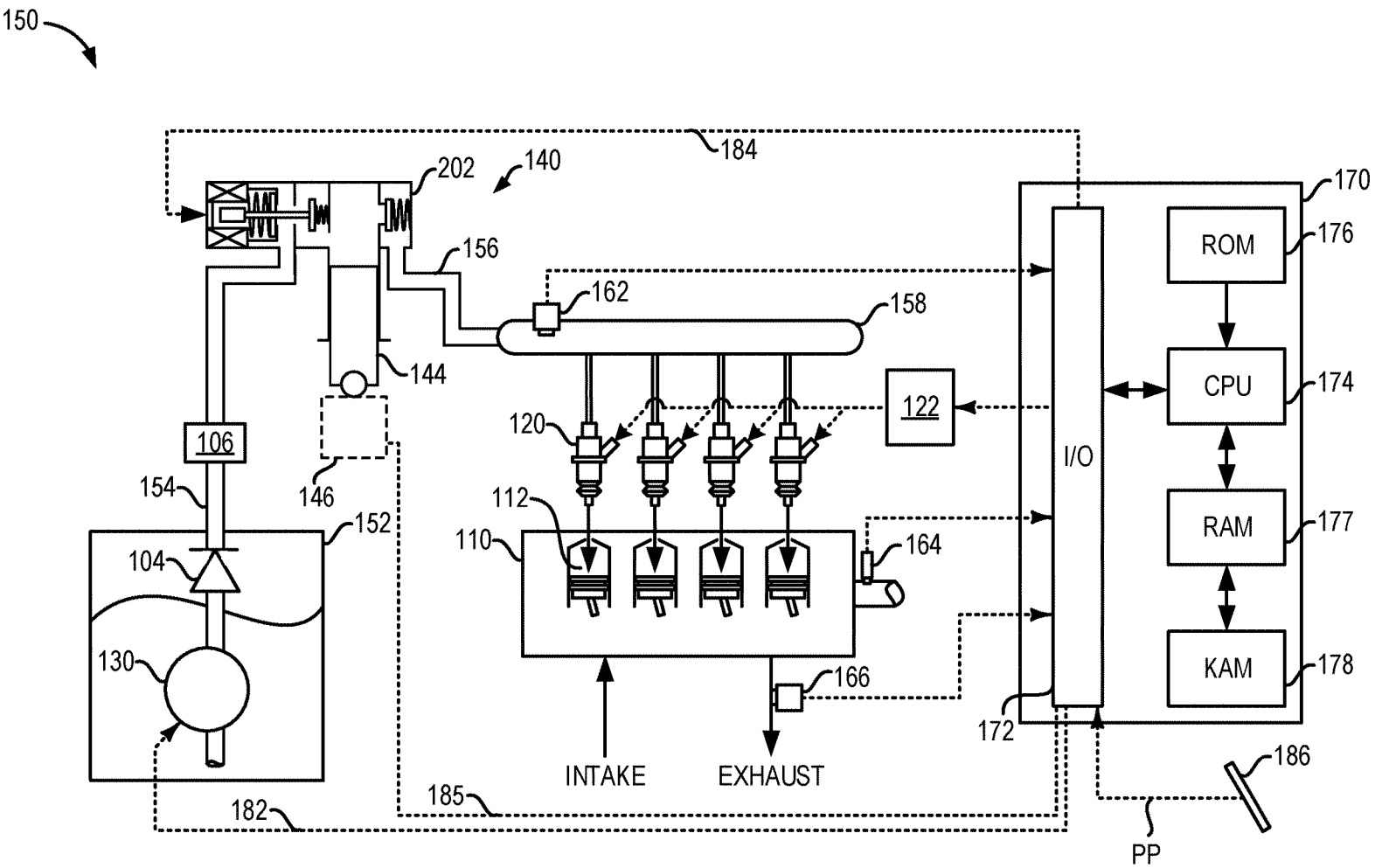
FIG. 1 shows a schematic diagram of a fuel system of a vehicle including an engine.

Referring to FIG. 1, fuel system 150 is shown including a direct injection (DI) fuel pump 140 coupled to an internal combustion engine 110. As one non-limiting example, engine 110 with fuel system 150 may be included as part of a propulsion system for a passenger vehicle. Engine 110 may be controlled at least partially by a control system including controller 170 and by input from a vehicle operator (not shown) via an input device 186. In this example, input device 186 includes an accelerator pedal and a pedal position sensor (not shown) for generating a proportional pedal position signal PP.

The internal combustion engine 110 may comprise multiple cylinders 112 (also termed combustion chambers). Fuel may be provided directly to the cylinders 112 via in-cylinder direct fuel injectors 120. Thus, each cylinder 112 may receive fuel from a respective direct fuel injector 120. As indicated schematically in FIG. 1, engine 110 may receive intake air and expel exhaust products of the combusted fuel. The engine 110 is configured to combust fuel, such as gasoline or diesel fuel, provided to cylinders 112 via fuel system 150.

Fuel may be provided to the engine 110 via direct fuel injectors 120 by way of fuel system 150. The fuel system 150 may include a fuel storage tank 152 for storing the fuel on-board the vehicle and a low-pressure fuel pump 130 (e.g., a fuel lift pump) configured to flow fuel from the fuel storage tank 152 to direct injection (DI) fuel pump 140. The fuel system 150 further includes a fuel rail 158 and various fuel passages (e.g., fuel passage 154 and fuel passage 156) fluidly coupling the direct injection fuel pump 140 to direct fuel injectors 120. Fuel passage 154 may carry fuel from the low-pressure fuel pump 130 to the DI fuel pump 140, and fuel passage 156 may carry fuel from the DI fuel pump 140 to the fuel rail 158. As such, fuel passage 154 may be a low-pressure passage (or a low-pressure fuel line) while fuel passage 156 may be a high-pressure passage. Fuel rail 158 may be a high pressure fuel rail fluidically coupling an outlet of the direct injection fuel pump 140 to direct fuel injectors 120.

Fuel rail 158 may distribute fuel to each of the plurality of direct fuel injectors 120. Each of the plurality of direct fuel injectors 120 may be positioned in a corresponding cylinder 112 of engine 110 such that during operation of direct fuel injectors 120, fuel is injected directly into each corresponding cylinder 112. Alternatively (or in addition), engine 110 may include fuel injectors positioned at the intake port of each cylinder such that during operation of the fuel injectors, fuel may be injected to the intake port of each cylinder. In the illustrated embodiment, engine 110 includes four cylinders. However, it will be appreciated that the engine may include a different number of cylinders without departing from the scope of this disclosure.

The low-pressure fuel pump 130 may be operated by controller 170, as indicated at 182, to provide fuel to DI fuel pump 140 via fuel passage 154. The low-pressure fuel pump 130 may be configured as what may be referred to as a lift pump. As one example, low-pressure fuel pump 130 may include an electric pump motor, whereby the pressure increase across the low-pressure fuel pump and/or the volumetric flow rate through the low-pressure fuel pump may be controlled by varying the electrical power provided to the pump motor, thereby increasing or decreasing the motor speed. For example, as the controller 170 reduces the electrical power that is provided to low-pressure fuel pump 130, the volumetric flow rate and/or pressure increase across the pump may be reduced. The volumetric flow rate and/or pressure increase across the pump may be increased by increasing the electrical power that is provided to the low-pressure fuel pump 130. As one example, the electrical power supplied to the low-pressure pump motor may be obtained from an alternator or other energy storage device on-board the vehicle (not shown), whereby the control system may control the electrical load that is used to power the low-pressure fuel pump. Thus, by varying the voltage and/or current provided to the low-pressure fuel pump, the flow rate and pressure of the fuel provided to DI fuel pump 140 and ultimately to the fuel rail 158 may be adjusted by the controller 170.

Low-pressure fuel pump 130 may be fluidically coupled to check valve 104 to facilitate fuel delivery and maintain fuel line pressure. In particular, check valve 104 may include a ball and spring mechanism that seats and seals at a specified pressure differential to deliver fuel downstream. In some embodiments, fuel system 150 may include a series of check valves fluidically coupled to low-pressure fuel pump 130 to further impede fuel from leaking back upstream of the valves. Check valve 104 is fluidically coupled to filter 106 which may remove small impurities contained in the fuel that could potentially damage engine components. Fuel may be delivered from filter 106 to high-pressure fuel pump (e.g., DI fuel pump) 140. DI fuel pump 140 may increase the pressure of fuel received from filter 106 from a first pressure level generated by low-pressure fuel pump 130 to a second pressure level higher than the first pressure level. DI fuel pump 140 may deliver high pressure fuel to fuel rail 158 via fuel passage 156 (also termed fuel line). DI fuel pump 140 is discussed in further detail below with reference to FIG. 2.

The DI fuel pump 140 may be controlled by the controller 170 to provide fuel to the fuel rail 158 via the fuel passage 156. As one non-limiting example, DI fuel pump 140 may utilize a solenoid valve 202 (which may be referred to herein as a flow control valve or solenoid actuated spill valve) to enable the control system to vary the effective pump volume of each pump stroke, as indicated at 184. Solenoid valve (SV) 202 may be separate or part of (e.g., integrally formed with) DI fuel pump 140. The DI fuel pump 140 may be mechanically driven by the engine 110, whereas low-pressure fuel pump 130 may be a pump driven by an electric motor (e.g., as described above). A plunger 144 (which may be referred to herein as a pump piston) of the DI fuel pump 140 may receive a mechanical input from a cam 146 via an engine camshaft. In this manner, DI fuel pump 140 may operate as a cam-driven single-cylinder pump. Furthermore, the angular position of cam 146 may be estimated or determined by a position sensor (not shown) located near cam 146. The cam may communicate with controller 170 as shown via electronic connection 185. In particular, the sensor may measure an angle of cam 146 in degrees ranging from 0 to 360 degrees according to the rotational position of cam 146.

The fuel rail 158 includes a fuel rail pressure sensor 162 for providing an indication of fuel rail pressure to the controller 170. An engine speed sensor 164 may be used to provide an indication of engine speed to the controller 170. The indication of engine speed may be used to estimate and/or measure the speed of DI fuel pump 140 due to the DI fuel pump 140 being mechanically driven by the engine 110 (e.g., driven by the cam 146 via the camshaft). An exhaust gas sensor 166 may be used to provide an indication of exhaust gas composition to the controller 170. As one example, the gas sensor 166 may include a universal exhaust gas sensor (UEGO). The exhaust gas sensor 166 may provide feedback to the controller to adjust the amount of fuel that is delivered to the engine via the direct fuel injectors 120. In this way, the controller 170 may control the air/fuel ratio delivered to the engine to a prescribed set-point.

The controller 170 receives signals from the various sensors of FIG. 1 and employs the various actuators of FIG. 1 to adjust engine operation based on the received signals and instructions stored on a memory of the controller. For example, the controller 170 may receive engine/exhaust parameter signals from engine sensors such as from sensors estimating engine coolant temperature, engine speed, throttle position, absolute manifold pressure, emission control device temperature, etc. Further still, controller 170 may provide feedback control based on signals received from fuel composition sensor 148, fuel rail pressure sensor 162, and engine speed sensor 164, among others. For example, controller 170 may send signals to adjust a current level, current ramp rate, pulse width of solenoid valve (SV) 202 of DI fuel pump 140, and the like via connection 184 to adjust operation of DI fuel pump 140. Also, controller 170 may send signals to adjust a fuel pressure set-point of the fuel pressure regulator and/or a fuel injection amount and/or timing based on signals from fuel rail pressure sensor 162, engine speed sensor 164, and the like.

The controller 170 may individually actuate each of the direct fuel injectors 120 via a fuel injection driver 122. The controller 170, the driver 122, and other suitable engine system controllers may be referred to collectively as a control system. While the driver 122 is shown external to the controller 170, in other examples, the controller 170 may include the driver 122 or may be configured to provide the functionality of the driver 122. The controller 170, in this particular example, includes an electronic control unit comprising one or more of an input/output device 172, a central processing unit (CPU) 174, read-only memory (ROM) 176, random-accessible memory (RAM) 177, and keep-alive memory (KAM) 178. The storage medium ROM 176 may be programmed with computer readable data representing non-transitory instructions executable by the processor 174 for performing the methods described below as well as other variants that are anticipated but not specifically listed.

As shown, fuel system 150 is a returnless fuel system, and may be a mechanical returnless fuel system (MRFS) or an electronic returnless fuel system (ERFS). In the case of an MRFS, the fuel rail pressure may be controlled via a pressure regulator (not shown) positioned at the fuel storage tank 152. In an ERFS, fuel rail pressure sensor 162 mounted at the fuel rail 158 may measure the fuel rail pressure relative to the manifold pressure. The signal from the fuel rail pressure sensor 162 may be fed back to the controller 170, which controls the driver 122, the driver 122 modulating the voltage to the DI fuel pump 140 for supplying the correct pressure and fuel flow rate to the injectors.

In some examples, fuel system 150 may include a return line whereby excess fuel from the engine is returned via a fuel pressure regulator to the fuel tank via the return line. The fuel pressure regulator may be coupled in line with the return line to regulate fuel delivered to fuel rail 158 at a set-point pressure. To regulate the fuel pressure at the set-point, the fuel pressure regulator may return excess fuel to fuel storage tank 152 via the return line. It will be appreciated that operation of fuel pressure regulator may be adjusted to change the fuel pressure set-point to accommodate operating conditions.

As presented above, DI fuel pump 140 is a piston pump that is controlled to compress a fraction of its full displacement by varying closing timing of the solenoid spill valve. As such, a full range of pumping volume fractions may be provided to the direct injection fuel rail and direct fuel injectors depending on when the solenoid valve 202 is energized and de-energized. For example, 50% pumping volume (or a 50% duty cycle) may be provided by energizing solenoid 206 (shown by FIG. 2) of SV 202 approximately midway through an output stroke in the DI fuel pump. Thus, approximately 50% of the DI fuel pump volume may be pressurized and pumped to fuel rail 158. Top-dead-center position may refer to the plunger reaching a maximum height (e.g., depth_in the pump pressure chamber (e.g., a position corresponding to a minimum volume of the pressure chamber of the pump). Herein, even though SV 202 is de-energized, the higher pressure within the pressure chamber 212 (as TDC position is approached by plunger 144) may retain inlet valve 208 in its closed position such that fuel may not flow out of pressure chamber 212 towards fuel passage 154. Further still, since pressure within the pressure chamber 212 is higher, fuel may not enter the pressure chamber 212 through inlet valve 208 even when solenoids 206 are de-energized. Pressure chamber 212 may be referred to herein as a compression chamber.

Referring to FIG. 2, an enlarged view of DI fuel pump 140 is shown. DI fuel pump 140 intakes fuel and delivers fuel to the engine by pumping fuel to fuel rail 158 (shown by FIG. 1). The DI fuel pump 140 includes an outlet 219 fluidically coupled to direct injection fuel rail 158. As seen, the DI fuel pump includes plunger 144 configured to move linearly to cause the DI fuel pump to intake, compress, and eject (e.g., deliver) fuel. SV 202 is fluidically coupled to an inlet of the direct injection fuel pump. Further still, low-pressure fuel pump 130 may be fluidically coupled to SV 202 via fuel passage 154, as shown in FIG. 1.

SV 202 includes solenoids 206 that may be electrically energized by controller 170. Energization of the SV 202, as described herein, refers to energization of the solenoids 206 of SV 202. By energizing solenoids 206, plunger 204 may be drawn towards the solenoids 206 away from the inlet valve 208 and toward plate 210. SV 202 may be a normally-open solenoid actuated spill valve such that during conditions in which the SV 202 is not energized, inlet valve 208 of SV 202 is held open and the SV 202 does not pump fuel to fuel rail 158. However, during conditions in which the SV 202 is energized, the inlet valve 208 functions as a check valve such that fuel may flow from the fuel passage 154 through the inlet valve 208 to the pressure chamber 212, but fuel does not flow from the pressure chamber 212 through the inlet valve 208. Depending on the timing of the energizing of SV 202, a given amount of pump displacement of SV 202 may be used to push a given fuel volume into the fuel rail 158. Thus, SV 202 may function as a fuel volume regulator. The angular timing of the energization of the SV 202 (e.g., the cam angle at which the SV 202 is energized) may control the effective pump displacement.

Moving the plunger 204 toward the solenoids 206 and plate 210 via energization of the solenoids 206 results in inlet valve 208 functioning as a check valve as described above, where fuel may flow into pressure chamber 212 and fuel may be blocked from flowing out of pressure chamber 212. For example, during conditions in which SV 202 is energized, inlet valve 208 is closed in one direction such that fuel may flow through inlet valve 208 only toward pressure chamber 212, and during conditions in which SV 202 is not energized, inlet valve 208 is opened such that fluid may flow through inlet valve 208 to and/or from pressure chamber 212. As such, the pump may maintain the pumping function (e.g., the pump may flow fuel to the fuel rail 158) while the inlet valve 208 does not flow fuel to the fuel passage 154. Further, controller 170 may send a pump signal that may be modulated to adjust the operating state (e.g., open or closed) of SV 202. Modulation of the pump signal may include adjusting an electrical current level, electrical current ramp rate, an electrical pulse-width, a duty cycle, or another modulation parameter of the solenoids 206 of SV 202. Further still, plunger 204 may be biased by a biasing member (e.g., a spring, such as spring 209) such that, upon de-energizing of solenoids 206, plunger 204 may move away from the solenoids 206 toward the opened position. As such, the SV 202 may be placed in an open state allowing fuel to flow into, and out of, pressure chamber 212 of DI fuel pump 140. As will be described in reference to FIG. 3, SV 202 may be held in a closed state even though solenoids 206 are de-energized when a pressure (e.g., fuel pressure) within pressure chamber 212 of the DI fuel pump 140 is higher than a pressure of fuel within the fuel passage 154. Operation of plunger 144 of DI fuel pump 140 may increase the pressure of fuel in pressure chamber 212 when SV 202 is closed. Upon reaching a pressure set-point (e.g., a threshold pressure sufficient to open outlet valve 216 by compressing a biasing member, such as spring 217, that otherwise maintains the outlet valve 216 in a closed position), fuel may flow through outlet valve 216 to fuel rail 158.

Referring to FIG. 3, an example operating sequence of DI fuel pump 140 is shown depicting a first control strategy 300 wherein the solenoid actuated spill valve is de-energized prior to the plunger reaching the TDC position. In particular, first control strategy 300 shows the operation of DI fuel pump 140 during intake and delivery strokes of fuel supplied to fuel rail 158. Delivery strokes may be referred to herein as compression strokes and/or output strokes. Each of the illustrated pump operating conditions (e.g., first condition 310, second condition 320, third condition 330, and fourth condition 340) of first control strategy 300 show events or changes in the operating state of DI fuel pump 140. Dashed arrows within the illustrated conditions indicate fuel flow. Signal timing chart 302 shows a pump position 350 and solenoid current 370 resulting from voltage applied to the DI fuel pump 140 (e.g., applied to the solenoids 206 of DI fuel pump 140). Time is plotted along x-axis wherein time increases from left to right of the x-axis.

At time A, the DI fuel pump may initiate an intake stroke as the plunger 144 is pushed outwards from pressure chamber 212 from the top-dead-center (TDC) position (e.g., the amount of lift of the plunger 144 decreases). SV applied voltage 360 (e.g., pull-in applied voltage) is maintained at 0% duty cycle (GND) such that the inlet valve 208 of SV 202 is maintained in the opened position, allowing fuel to flow from the fuel passage 154 to the pressure chamber 212. First condition 310 illustrates a moment during the intake stroke wherein SV 202 is de-energized. At time B, plunger 144 reaches the bottom-dead-center (BDC) position. In this position, the plunger 144 is retracted from the pressure chamber 212 prior to an output stroke immediately following the intake stroke, with the intake stroke and output stroke forming a single cycle of the DI fuel pump.

The top-dead-center position of the plunger 144 refers to the furthest position of the plunger 144 within the pressure chamber 212 of the DI fuel pump 140. In the TDC position, the displacement volume of the pressure chamber is the lowest amount of volume relative to conditions in which the plunger 144 is at the BDC position. The bottom-dead-center position of plunger 144 refers to the position in which the plunger 144 is furthest retracted from the pressure chamber 212 (e.g., moved furthest away from wall 221 of the pressure chamber 212) such that the displacement volume of the pressure chamber is at the highest amount relative to conditions in which the plunger 144 is in the TDC position. Second condition 320 depicts a moment at the beginning of the output stroke immediately following the intake stroke described above with reference to first condition 310. In the second condition 320, SV 202 remains de-energized and fuel may flow into, and out of, pressure chamber 212 as shown by dashed arrows. A portion of the fuel in pressure chamber 212 may be pushed out past inlet valve 208 before the inlet valve 208 fully closes as the plunger 144 travels towards the TDC position.

Prior to fuel delivery, a pull-in impulse 362 of the SV applied voltage 360 is initiated at time S1 to close SV 202 (e.g., such that inlet valve 208 functions as a check valve). In response to the pull-in impulse 362, the solenoid current 370 begins to increase. Accordingly, SV 202 may be energized at time S1, and energization of SV 202 may refer to conditions in which the pull-in impulse 362 is applied to SV 202. During the pull-in impulse 362, the SV applied voltage 360 signal may be 100% duty cycle, however, the SV applied voltage 360 signal may also be less than 100% duty cycle. Furthermore, the duration of the pull-in impulse 362, the duty cycle impulse level, and the duty cycle impulse profile (e.g., square profile, ramp profile, and the like) may be adjusted corresponding to the SV, fuel system, engine operating conditions, and the like. By controlling the pull-in current level, pull-in current duration or the pull-in current profile, the interaction between the solenoid armature and plunger 204 may be controlled.

At time C (and as shown by the illustrated third condition 330), SV 202 may continue to be energized and may be fully closed responsive to the SV applied voltage pull-in impulse and the increasing solenoid current 370. Accordingly, at time C, inlet valve 208 functions as a check valve to block fuel flow out of pressure chamber 212. At time C, approximately 50% of a total amount of fuel to be disposed within the pressure chamber during the output stroke may be trapped within the pump to be pressurized and delivered to fuel rail 158. Further, at time C, outlet valve 216 is opened, allowing for fuel flow from the pressure chamber 212 into fuel rail 158.

Following time C and prior to time D, the SV pull-in applied voltage 360 may be set to a holding signal 364 of approximately 25% duty cycle to command a holding solenoid current 370 in order to maintain the inlet valve 208 in the closed position during fuel delivery. At the end of the holding current duty cycle, which is coincident with time μl, SV applied voltage is adjusted to ground (GND), lowering the solenoid current 370. As such, solenoids 206 of SV 202 may be de-energized at time μl, prior to plunger 144 reaching the TDC position. Even though solenoids 206 of SV 202 may be de-energized at μl, inlet valve 208 may remain closed due to the increased pressure within pressure chamber 212 until the beginning of a subsequent intake stroke. Herein, fuel flow from fuel passage 154 into pressure chamber 212 may not occur and fuel flow from pressure chamber 212 towards fuel passage 154 may also be impeded. If pressure within pressure chamber 212 is higher, deactivation plunger spring force of inlet valve 208 may not overcome the pressure of the pressure chamber 212. However, fuel may continue to flow from pressure chamber 212 towards fuel rail 158 via outlet valve 216 as shown by the illustrated fourth condition 340.

Upon completion of the delivery stroke at time D (e.g., with the plunger 144 at the TDC position), the plunger 144 begins a subsequent intake stroke (e.g., an intake stroke immediately following the output stroke between time B and time D as described above). Inlet valve 208 may open as pressure within pressure chamber 212 decreases. Therefore, inlet valve 208 of SV 202 may be held in the closed position from time C until TDC is reached (e.g., at time D). As such, when fuel trapping amounts within the pressure chamber are substantial, compression pressure (e.g., fuel pressure) within the pressure chamber of the DI fuel pump may hold inlet valve 208 closed until the plunger 144 reaches the TDC position even though solenoids 206 may be de-energized at an earlier time (e.g. between time C and time D).

It will be appreciated that time C may occur anywhere between time B, when plunger 144 reaches the BDC position, and time D, when plunger 144 reaches the TDC position to complete a cycle of the pump and to start the next cycle (e.g., where each cycle includes one output stroke immediately following one intake stroke, with no other strokes in between, such that the intake stroke and output stroke together form one cycle). Particularly, SV 202 and consequently, inlet valve 208 may fully close at any moment between the BDC and TDC positions of plunger 144, thereby controlling the amount of fuel that is pumped by DI fuel pump 140. As previously mentioned, the amount of fuel may be referred to as a fractional trapping volume or fractional pumped displacement, which may be expressed as a decimal or percentage. For example, the trapping volume fraction is 100% when the solenoid spill valve is energized to a closed position coincident with the beginning of an output stroke of the piston of the direct injection fuel pump.

Energizing and de-energizing solenoids 206 of SV 202 may be controlled by controller 170 based on the angular position of cam 146 received via connection 185 (with controller 170 and connection 185 shown by FIG. 1 and described above). In other words, SV 202 may be controlled (e.g., activated and deactivated) in synchronization with the angular position of cam 146. The angular position of cam 146 may correspond to the linear position of plunger 144, that is, when plunger 144 is at TDC or BDC or any other position in between. In this way, the applied voltage (e.g., energizing) to SV 202 to open or close the inlet may occur between BDC and TDC of plunger 144. As described herein, the applied voltage to SV 202 to deliver fuel to the fuel rail may occur during conditions in which the plunger 144 is undergoing a decrease in speed and velocity at a constant rate. For example, for conditions of lower engine load (e.g., cruising speeds), the energization of the solenoid 206 of SV 202 may occur during a main portion of the output stroke, where, throughout the main portion, the speed of the plunger decreases at the constant rate.

The position of the plunger of the direct injection fuel pump may vary between the TDC and BDC positions as described above. The solenoid valve position may either be open or closed based on applied electrical voltage and electrical current to the solenoid valve. For example, the open position may occur during conditions in which no voltage is applied to SV 202 and SV 202 is de-energized or deactivated (e.g., the solenoid valve may be a normally opened solenoid valve). The closed position of SV 202 may occur when electrical voltage is applied to SV 202, and SV 202 is energized or activated. The angular position of the cam may be measured by a position sensor. The cam may be rotated to any position of a continuous plurality of positions (e.g., 15 degrees, 30 degrees, 70 degrees, etc.) as the cam rotates through a full rotational cycle. In some examples, such as the example described below with reference to FIG. 4, the cam may be configured with four lobes and a full cycle of the cam may occur over 90 degrees of rotation of the cam (e.g., such that four full cycles occur for each full rotation of the cam, where a full rotation of the cam is 360 degrees of rotation). However, in other examples, the cam may be configured with a different number of lobes (e.g., two lobes) and a fully cycle of the cam may occur over a different number of degrees of rotation of the cam (e.g., 180 degrees of rotation). As referred to herein, a minimum angular duration may correspond to the number of degrees of rotation of the cam 146 (and the connected engine camshaft) upon which the activation (and deactivation) of SV 202 is based. In some examples, the full cycle of cam 146 may correspond to the full DI fuel pump cycle consisting of one intake stroke and one output stroke, as shown in FIG. 3.

Referring to FIG. 4, a chart 400 with a plot 402 of a plunger lift amount versus cam angle relationship for a cam of a direct injection fuel pump of a vehicle fuel system is shown according to the present disclosure. In some examples, the plunger, cam, direct injection fuel pump, and vehicle fuel system described herein with reference to chart 400 may be similar to (or the same as) the plunger 144, cam 146, direct injection fuel pump 140, and vehicle fuel system 150 described above with reference to FIG. 1. The horizontal axis of chart 400 illustrates cam angle (e.g., a rotational position of the cam) and the vertical axis of chart 400 illustrates plunger lift (e.g., a position of the plunger within the direct injection fuel pump). The cam angle may be measured by a position sensor, as described above, and the rotational position of the cam may be relative to a pre-determined, initial rotational position of the cam (e.g., 0 degrees of rotation). The plunger lift amount may be measured relative to a pre-determined position of the plunger. For example, 0 millimeters of plunger lift as illustrated by chart 400 may correspond to a BDC position of the plunger (e.g., a position in which the plunger is furthest retracted from a pressure chamber of the fuel pump, similar to pressure chamber 212 described above with reference to FIG. 2).

The total amount of fuel output by the direct injection fuel pump (e.g., the pump displacement volume) is a function of the amount of movement of the plunger. For example, as the plunger moves from BDC to TDC during a single cycle, the amount of fuel output by the fuel pump during the single cycle may increase depending on the energization timing of the solenoid valve of the fuel pump during the output stroke of the single cycle. Further, the speed of the flow of fuel from the fuel pump may be a function of the plunger speed (e.g., amount of plunger lift per cam angle or cam rotation amount) during conditions in which the solenoid of the fuel pump is energized. For example, during conditions in which energization of the solenoid occurs earlier in the output stroke (e.g., at a lower amount of cam angle, such as 55 degrees), the flow speed of fuel output by the fuel pump may be relatively high, and during conditions in which energization of the solenoid occurs later in the output stroke (e.g., at a higher amount of cam angle, such as 70 degrees), the flow speed of fuel output by the fuel pump may be relatively lower. However, for each engine operating condition (e.g., engine speed), the plunger speed of the fuel pump is decreased during at least half of each output stroke as described further below, such that the speed of a total flow of fuel through the fuel pump (e.g., to the fuel rail and/or returning to the fuel passage) is similarly decreased during at least half of each output stroke.

The plot 402 shows the plunger lift versus cam angle relationship independent of engine speed (e.g., for both lower and higher engine speeds). In particular, as the operating speed of the engine changes (e.g., increases or decreases), the plunger lift versus cam angle relationship shown by plot 402 does not change. Although the cam may be driven (e.g., rotate) more quickly at higher engine speeds due to the camshaft being driven (e.g., rotated) more quickly by the engine, the plunger lift correspondingly changes with the cam rotation speed (e.g., cam rotation rate) such that the plunger lift versus cam angle relationship shown by plot 402 is maintained (e.g., the same) for each different engine speed. A controller of the vehicle fuel system, such as the controller 170 described above with reference to FIG. 1, may adjust operation of the direct injection fuel pump similar to the examples described above (e.g., the controller may adjust the energization timing of the solenoid valve of the direct injection fuel pump in order to control an amount of fuel delivered by the fuel pump to a fuel rail, such as fuel rail 158 described above with reference to FIG. 1).

The plot 402 shown by FIG. 4 corresponds to a single cycle of the direct injection fuel pump according to the present disclosure, with the single cycle including an intake stroke and an output stroke immediately following the intake stroke. In particular, the portions of plot 402 including the higher density, first stipple shading correspond to the intake stroke, and the portions of plot 402 including the lower density, second stipple shading correspond to the output stroke. In the example shown by FIG. 4, the TDC position of the plunger corresponding to the start of the intake stroke occurs at the cam angle indicated by marker 412, with the marker 412 positioned along the horizontal axis and intersected by vertical axis 406. The BDC position of the plunger (e.g., 0 mm of plunger lift) corresponding to the end of the intake stroke and the start of the output stroke occurs at the cam angle indicated by marker 404, with the marker 404 positioned along the horizontal axis and intersected by axis 408. The TDC position of the plunger corresponding to the end of the output stroke occurs at the cam angle indicated by marker 414, with the marker 414 positioned along the horizontal axis and intersected by vertical axis 410.

As shown by FIG. 4, the shape of plot 402 at the intake stroke portion is asymmetrical relative to the shape of plot 402 at the output stroke portion. In particular, a slope 420 of the plot 402 at the intake stroke portion is steeper than a slope 422 of the plot 402 at the output stroke portion, such that the rate of change of the plunger lift versus cam angle (e.g., the plunger speed) at the intake stroke portion is greater than the rate of change of the plunger lift versus cam angle at the output stroke portion. The intake stroke portion occurs over a first amount 411 of cam rotation (e.g., a first range of cam angle), and the output stroke portion occurs over a second amount 413 of cam rotation (e.g., a second range of cam angle), with the second amount 413 being greater than the first amount 411 (e.g., the second amount 413 includes a larger amount of cam rotation, or being a larger amount of cam angle, than the first amount 411). During the intake stroke, the plunger moves through an amount of lift 416, and during the output stroke, the plunger moves through an amount of lift 418, with the amount of lift 416 being the same amount of lift (e.g., a same length) as the amount of lift 418. In some examples, the amount of lift 416 and the amount of lift 418 may be within a range of 4 to 4.5 millimeters (e.g., 4.2 millimeters, 4.3 millimeters, etc.). Because the plunger moves from the TDC position to the BDC position during the intake stroke, and because the plunger moves from the BDC position to the TDC position during the output stroke, the plunger travels a same amount of length during each of the intake stroke and output stroke (e.g., the plunger moves through a same amount of plunger lift during the intake stroke relative to the output stroke). However, because the output stroke occurs over a larger amount of cam rotation relative to the intake stroke (e.g., the second amount 413 of cam rotation described above), the output stroke may occur over a longer duration (e.g., longer amount of time) relative to the corresponding intake stroke for a given cam rotation rate. One or more lobes of the cam may be shaped to provide the decreased plunger speed during the output stroke relative to the increased plunger speed during the intake stroke. For example, although the cam may rotate at a rate based an operating speed of the engine (e.g., due to the cam being rotated via a camshaft driven by the engine), the cam profile (e.g., the shape of the cam) is configured to provide the plunger lift versus cam angle relationship shown by plot 402 of the chart 400 of FIG. 4.

In the example shown, the combined first amount 411 and second amount 413 are together equal to 90 degrees of cam rotation, such that the cam rotates by 90 degrees for each full cycle (e.g., for each cycle including an output stroke immediately following an intake stroke, similar to the example shown by FIG. 2). In this example, the cam may include four lobes, such that for each full rotation of the cam (e.g., 360 degrees of rotation), four full cycles occur. However, in other examples, the combined first amount 411 and second amount 413 may together be equal to a different amount of cam rotation (e.g., 180 degrees, 120 degrees, etc.) depending on the number of lobes of the cam. As one example, the cam may include a single lobe, where the combined first amount 411 and second amount 413 are together equal to 360 degrees of cam rotation (e.g., each full rotation of the cam results in one cycle including one intake stroke and one output stroke). As another example, the cam may include two lobes, where the combined first amount 411 and second amount 413 are together equal to 180 degrees of cam rotation (e.g., each full rotation of the cam results in two cycles, where each cycle includes one intake stroke and one output stroke). Other examples are possible.

Referring to FIG. 5, a chart 500 with a plot 502 illustrating a conventional plunger lift amount versus cam angle relationship for a cam of a direct injection fuel pump of a vehicle fuel system is shown. In the conventional example shown by FIG. 5, the cam of the direct injection fuel pump is configured to provide a symmetrical plunger lift versus cam angle relationship for the intake stroke and output stroke. In particular, the portions of plot 502 including the higher density, first stipple shading correspond to the intake stroke, and the portions of plot 502 including the lower density, second stipple shading correspond to the output stroke. In the example shown by FIG. 5, the TDC position of the plunger corresponding to the start of the intake stroke occurs at the cam angle indicated by marker 512, with the marker 512 positioned along the horizontal axis and intersected by vertical axis 506. The BDC position of the plunger (e.g., 0 mm of plunger lift) corresponding to the end of the intake stroke and the start of the output stroke occurs at the cam angle indicated by marker 504, with the marker 504 positioned along the horizontal axis and intersected by axis 508. The TDC position of the plunger corresponding to the end of the output stroke occurs at the cam angle indicated by marker 514, with the marker 514 positioned along the horizontal axis and intersected by vertical axis 510.

As shown by FIG. 5, the shape of plot 502 at the intake stroke portion is symmetrical relative to the shape of plot 502 at the output stroke portion. In particular, a slope 520 of the plot 502 at the intake stroke portion has a same amount of steepness as a slope 522 of the plot 502 at the output stroke portion, such that the rate of change of the plunger lift versus cam angle (e.g., the plunger speed) at the intake stroke portion has a same magnitude as the rate of change of the plunger lift versus cam angle at the output stroke portion. The intake stroke portion occurs over a first amount 511 of cam rotation (e.g., a first range of cam angles), and the output stroke portion occurs over a second amount 513 of cam rotation (e.g., a second range of cam angles), with the second amount 513 being a same amount of cam rotation as the first amount 511. During the intake stroke, the plunger moves through an amount of lift 530, and during the output stroke, the plunger moves through an amount of lift 532, with the amount of lift 530 being the same amount of lift (e.g., a same length) as the amount of lift 532. In the example shown, the shape of the plot 502 is symmetric about the axis 508 such that the rate at which the plunger retracts during the intake stroke portion (e.g., the rate at which the plunger lift decreases per cam angle) has the same magnitude as the rate at which the plunger lifts during the output stroke portion. As described above, the intake stroke portion occurs over first amount 511 of cam rotation, and the output stroke portion occurs over second amount 513 of cam rotation, with the second amount 513 being a same amount of cam rotation as the first amount 511. The combined first amount 511 and second amount 513 are together equal to 90 degrees of cam rotation (e.g., with the first amount 511 and second amount 513 each being 45 degrees of cam rotation), such that the cam rotates by 90 degrees for each full cycle (e.g., for each cycle including an output stroke immediately following an intake stroke). The cam may include four lobes, such that for each full rotation of the cam (e.g., 360 degrees of rotation), four full cycles occur. Because the output stroke occurs over the same amount of cam rotation relative to the intake stroke (e.g., 45 cam degrees for the intake stroke, and 45 degrees for the output stroke immediately following the intake stroke), the output stroke occurs over an equal duration (e.g., equal amount of time) relative to the corresponding intake stroke for a given cam rotation rate.

Referring to FIG. 6, a chart 600 includes plot 402 shown by FIG. 4 and described above, as well as plot 502 shown by FIG. 5 and described above. Plot 402 and plot 502 are included by chart 600 for purposes of comparison. Chart 600 includes axis 406, axis 408, axis 410, marker 412, marker 404, and marker 414 described above with reference to FIG. 4 and shown in the same arrangement as FIG. 4. Chart 600 additionally includes axis 506, axis 508, axis 510, marker 512, marker 504, and marker 514 described above with reference to FIG. 5 and shown in the same arrangement as FIG. 5.

As illustrated by length 602 between the axis 406 intersecting the marker 412 and the axis 506 intersecting the marker 512, as well as the length 604 between the axis 410 intersecting the marker 414 and the axis 510 intersecting the marker 514, the plot 402 is offset (e.g., out-of-phase) relative to the plot 502. However, the plot 402 and plot 502 are shown offset from each other for convenience of illustration, and in some examples, the plot 402 may be shown in-phase relative to the plot 502. In the example shown, the TDC position of the plunger at the start of the intake stroke as represented by plot 402 occurs out-of-phase relative to the conventional example (e.g., the TDC position of the plunger at the start of the intake stroke as represented by plot 502). In particular, length 602 is representative of an amount of cam rotation (e.g., cam angle) by which the TDC position indicated by plot 402 is offset from the TDC position indicated by plot 502. Additionally, the TDC position of the plunger at the end of the output stroke as represented by plot 402 occurs out-of-phase relative to the conventional example (e.g., the TDC position of the plunger at the end of the output stroke as represented by plot 502). The length 602 and the length 604 are a same amount of length. However, although the plot 402 is offset from the plot 502 in the direction of the x-axis as described above (e.g., by an amount equal to length 602 or length 604, with length 602 and length 604 being a same amount of length), length 606 between the axis 508 intersecting marker 504 and the axis 408 intersecting marker 404 is not the same amount of length as the length 602 or length 604. In the example shown, the length 606 is less (e.g., a smaller amount of cam rotation) than each of the length 602 and length 604. In this configuration, even if the plot 402 and plot 502 were in-phase such that the TDC position of the intake stroke represented by plot 402 occurred at the same cam angle as the TDC position of the intake stroke of the conventional example represented by plot 502, the intake stroke represented by plot 402 of the present disclosure occurs over a smaller amount of cam rotation (e.g., first amount 411 shown by FIG. 4 and described above) relative to the intake stroke of the conventional example, and the output stroke represented by plot 402 of the present disclosure occurs over a larger amount of cam rotation (e.g., second amount 413 shown by FIG. 4 and described above) relative to the output stroke of the conventional example. As a result, the output stroke represented by plot 402 of the present disclosure may reduce NVH associated with operation of the direct injection fuel pump by decreasing abrupt changes to internal fuel pressure within the fuel pump via the decreased rate at which the plunger is adjusted from the BDC position to the TDC position.

Referring to FIG. 7, a chart 700 with a plot 702 illustrating a plunger velocity versus cam angle relationship for the cam of the direct injection fuel pump of the vehicle fuel system described above with reference to FIG. 4 is shown according to the present disclosure. The horizontal axis of chart 700 indicates cam angle (e.g., amount of cam rotation), and the vertical axis of chart 700 indicates plunger velocity (e.g., the rate of movement of the plunger of the fuel pump in the direction into the pressure chamber of the fuel pump or retracting from the pressure chamber of the fuel pump, depending on whether the velocity is positive or negative, respectively). Horizontal axis 706 indicates a change in direction of the plunger velocity, where portions of plot 702 vertically above the axis 706 indicate movement of the plunger in the direction toward the TDC position of the plunger, and portions of the plot 702 vertically below the axis 706 indicate movement of the plunger in the direction toward the BDC position. For example, the portions of plot 702 including the higher density, first stipple shading correspond to the intake stroke where the plunger moves from the TDC position toward the BDC position as described above, and the portions of plot 702 including the lower density, second stipple shading correspond to the output stroke where the plunger moves from the BDC position toward the TDC position as described above. The marker 720 arranged at the intersection of axis 706 with the vertical axis 704 indicates a position at which the movement of the plunger transitions from the first direction (e.g., away from the pressure chamber during the intake stroke) to the second direction (e.g., toward the pressure chamber during the output stroke). The marker 722 is positioned along the horizontal axis at a location intersected by axis 704 and corresponding to the same cam angle as indicated by the marker 404 shown by FIG. 4.

The portion of plot 702 arranged vertically above the axis 706 indicating the output stroke of the single cycle of the direct injection fuel pump includes a beginning ramp portion 709, an end ramp portion 713, and a main portion 711. The beginning ramp portion 709 corresponds to increasing velocity of the plunger in the direction toward TDC, the end ramp portion 713 corresponds to decreasing velocity of the plunger in the direction toward TDC, and the main portion 711 corresponds to decreasing velocity of the plunger in the direction toward TDC for cam angles between the beginning ramp portion 709 and the end ramp portion 713. The velocity of the total flow of fuel through the fuel pump with respect to cam angle is a function of the plunger velocity (e.g., amount of plunger lift versus cam angle or cam rotation amount). For example, during conditions in which the plunger moves at larger, positive velocities (e.g., at the cam angle corresponding to the location of axis 726 along the horizontal axis), the flow velocity of fuel through the fuel pump (e.g., returning to the fuel passage or flowing to the fuel rail) may be relatively high, and during conditions in which the plunger moves at a smaller, positive velocities (e.g., at the cam angle corresponding to the location of axis 728 along the horizontal axis), the flow velocity of fuel through the fuel pump may be relatively lower. As one example, the flow velocity of fuel output by the fuel pump (e.g., to the fuel rail and/or the fuel passage fluidly coupled to the inlet of the fuel pump, depending on whether the solenoid valve of the fuel pump is energized or de-energized) may be higher during the main portion 711 of the output stroke compared to the flow velocity during the end ramp portion 713 of the output stroke.

The plot 702 shows the plunger velocity versus cam angle relationship independent of engine speed. In particular, as the operating speed of the engine changes (e.g., increases or decreases), the plunger velocity versus cam angle relationship shown by plot 702 does not change. Although the cam may be driven (e.g., rotate) more quickly at higher engine speeds due to the camshaft being driven (e.g., rotated) more quickly by the engine, the plunger velocity correspondingly changes with the cam rotation speed (e.g., cam rotation rate) such that the plunger velocity versus cam angle relationship shown by plot 702 is maintained (e.g., the same) for each different engine speed.

As one example operation of the direct injection fuel pump, the drive speed of the direct injection fuel pump may be maintained (e.g., the cam may rotate at a constant speed to drive the plunger of the fuel pump) while the flow speed of the total flow of fuel through the direct injection fuel pump (e.g., to return to the fuel passage and/or to flow to the fuel rail) is continuously reduced for at least half of the total duration (e.g., total length 743) of the output stroke. In particular, the flow speed of the total flow of fuel through the direct injection fuel pump is decreased at a first constant rate at the main portion 711 (e.g., as the plunger velocity decreases at the first constant rate), and the flow speed of the total flow of fuel through the direct injection fuel pump is decreased at a second constant rate at the end ramp portion 713 (e.g., as the plunger velocity decreases at the second constant rate).

The second constant rate is greater than the first constant rate (e.g., a magnitude of the second constant rate is larger than a magnitude of the first constant rate), as indicated by angle 718 between axis 712 and axis 714 (e.g., where the axis 714 aligned at the end ramp portion 713 is more steeply angled relative to the axis 712 aligned at the main portion 711). In some examples, the plunger velocity may decrease from 0.14 millimeters per degree of cam angle at a beginning of the main portion 711 (e.g., at axis 726) to 0.10 millimeters per degree of cam angle at an end of the main portion 711 (e.g., at axis 728), where the beginning of the main portion 711 and the end of the main portion 711 may be separated by approximately 20 degrees of cam angle (e.g., cam rotation corresponding to length 730). As such, the first constant rate may have a magnitude of 0.002 millimeters per degree-squared, in the example shown. Further, the plunger velocity may decrease from 0.09 millimeters per degree of cam angle at the beginning of the end ramp portion 713 (e.g., at axis 733) to 0 millimeters per degree of cam angle at the end of the end ramp portion 713 (e.g., at axis 744), where the beginning of the end ramp portion 713 and the end of the end ramp portion 713 may be separated by approximately 11 degrees of cam angle. As such, the second constant rate may have a magnitude of 0.008 millimeters per degree-squared, in the example shown. As the plunger velocity decreases, the flow speed of the total flow of fuel through the direct injection fuel pump also decreases accordingly.

The plunger velocity is continuously decreased throughout the main portion 711 at the first constant rate, and the plunger velocity is continuously decreased throughout the end ramp portion 713 at the second constant rate, as described above. As a result, the flow speed of the total flow of fuel through the direct injection fuel pump is continuously decreased throughout the main portion 711 at the first constant rate, and the flow speed is continuously decreased throughout the end ramp portion 713 at the second constant rate. Although the flow speed of the total flow of fuel through the direct injection fuel pump decreases continuously at the first constant rate during the main portion 711 and the second constant rate during the end ramp portion 713, the flow speed is not constant during either of the main portion 711 and end ramp portion 713 (e.g., the flow speed continuously decreases and is not maintained at a same, constant amount because the plunger velocity continuously decreases and is not maintained at a same, constant rate).

During an end transition portion 735 occurring between the main portion 711 and the end ramp portion 713 (with the end transition portion 735 occurring directly after the main portion 711 with no other portions therebetween, and with the end transition portion 735 occurring directly before the end ramp portion 713 with no other portions therebetween), the plunger velocity transitions from reducing at the first constant rate to reducing at the second constant rate. In particular, throughout the end transition portion 735 (e.g., at the portion of plot 702 arranged between axis 728 and axis 733, indicated by length 737), the plunger velocity gradually decreases at a non-constant rate. However, the non-constant rate is such that the plunger velocity throughout the end transition portion 735 does not decrease below the plunger velocities at the end ramp portion 713. Further, the non-constant rate is such that the plunger velocity throughout the end transition portion 735 does not increase above the plunger velocities at the main portion 711. Instead, the plunger velocity as shown by plot 702 decreases with a smooth curvature via the non-constant rate at the end transition portion 735 from the end of the main portion 711 (through which the plunger velocity decreases continuously at the first constant rate) to the beginning of the end ramp portion 713 (through which the plunger velocity decreases continuously at the second constant rate).

The flow speed of the total flow of fuel through the fuel pump at the beginning ramp portion 709 increases at a third rate (e.g., as indicated by axis 708). In some examples, the third rate may be a constant rate, and in other examples, the third rate may be a non-constant rate. In some examples, a magnitude of the third rate (or a magnitude of an average of the third rate, in examples in which the third rate is a non-constant rate) may be greater than the magnitude of the second constant rate. For example, at a beginning of the beginning ramp portion 709 (e.g., at axis 704), the plunger velocity may be 0 millimeters per degree of cam angle, and at an end of the beginning ramp portion 709 (e.g., at axis 726), the plunger velocity may be 0.14 millimeters per degree of cam angle, where the beginning of the beginning ramp portion 709 and the end of the beginning ramp portion 709 are separated by approximately 13 degrees of cam angle. As such, the third rate may have a magnitude of 0.011 millimeters per degree squared.

The total flow of fuel through the direct injection fuel pump (e.g., output by the direct injection fuel pump and not flowing into the direct injection fuel pump) may include flow directed to the fuel rail and flow directed to the fuel passage at the inlet of the fuel pump, depending on whether the solenoid valve of the fuel pump is energized or de-energized. For example, during conditions in which the solenoid valve is energized, the total flow of fuel may be directed entirely to the fuel rail, and during conditions in which the solenoid valve is de-energized, the total flow of fuel may be directed entirely to the fuel passage (e.g., returned to the fuel passage). However, the flow speed of the total flow of fuel is based on the movement of the plunger and not the direction of the flow. For example, during conditions in which the total flow of fuel is directed to the fuel rail through a given portion of the output stroke (e.g., the main portion 711), the speed of the fuel (e.g., volume of fuel pumped per second) may be the same as the speed of the fuel through the given portion of the output stroke during conditions in which the total flow of fuel is directed to the fuel passage (e.g., returned to the fuel passage).

The beginning ramp portion 709 is shown approximately parallel with axis 708, the end ramp portion 713 is shown approximately parallel with axis 714, and the main portion 711 is shown approximately parallel with axis 712. The axis 712 is not parallel with the horizontal axis, and as such, the main portion 711 does not indicate a condition of constant velocity of the plunger. Instead, at the main portion 711 between the beginning ramp portion 709 and the end ramp portion 713 of the output stroke, the velocity of the plunger gradually decreases. For example, the axis 712 is shown arranged at a first angle 716 relative to the axis 708, and the axis 712 is shown arranged at a second angle 718 relative to the axis 714, where the second angle 718 is larger (e.g., a larger amount of angle) relative to the first angle 716.

A length 740 (e.g., duration) of the beginning ramp portion 709 is shown, where the length 740 of the beginning ramp portion 709 is larger (e.g., a longer duration corresponding to a larger amount of cam rotation) than a length 742 of the end ramp portion 713 between axis 733 and axis 744. A length 730 of the main portion 711 is shown between vertical axis 726 and vertical axis 728 (with vertical axis 726 and vertical axis 728 each parallel to the vertical axis indicating plunger velocity of chart 700), where the length 730 indicates an amount of cam angle (e.g., cam rotation) through which the portion of the output stroke indicated by the main portion 711 occurs. The length 730 is configured to be a larger amount of length than conventional examples, as described further below with reference to FIG. 9. In particular, the combination of length 730 and length 742 is greater than at least half of the total length 743 of the output stroke (e.g., a total duration of the output stroke in cam rotation degrees). The decreasing velocity of the plunger as indicated by the main portion 711 may result in the attenuation of abrupt changes to internal fuel pressure within the fuel pump during conditions in which the solenoid valve of the fuel pump is energized during the main portion 711, relative to the conventional example in which the velocity of the plunger does not decrease. The resulting attenuation may decrease noise generated by the transition from returning fuel to the fuel passage to delivering fuel to the fuel rail, similar to the examples described above (e.g., with reference to FIG. 4).

Referring to FIG. 8, a chart 800 with a plot 802 illustrating a plunger velocity versus cam angle relationship for the conventional example of the cam of the direct injection fuel pump of the vehicle fuel system described above with reference to FIG. 5. The horizontal axis of chart 800 indicates cam angle (e.g., amount of cam rotation), and the vertical axis of chart 800 indicates plunger velocity (e.g., the rate of movement of the plunger of the fuel pump per cam angle in the direction into the pressure chamber of the fuel pump or retracting from the pressure chamber of the fuel pump, depending on whether the plunger velocity is positive or negative, respectively). Horizontal axis 806 indicates a change in direction of the plunger velocity, where portions of plot 802 vertically above the axis 806 indicate movement of the plunger in the direction toward the TDC position of the plunger, and portions of the plot 802 vertically below the axis 806 indicate movement of the plunger in the direction toward the BDC position. The portions of plot 802 including the higher density, first stipple shading correspond to the intake stroke where the plunger moves from the TDC position toward the BDC position, and the portions of plot 802 including the lower density, second stipple shading correspond to the output stroke where the plunger moves from the BDC position toward the TDC position. The marker 820 arranged at the intersection of axis 806 with the vertical axis 804 indicates a position at which the movement of the plunger transitions from the first direction (e.g., away from the pressure chamber during the intake stroke) to the second direction (e.g., toward the pressure chamber during the output stroke). The marker 822 is positioned along the horizontal axis at a location intersected by axis 804 and corresponding to the same cam angle as indicated by the marker 504 shown by FIG. 5.

The portion of plot 802 arranged vertically above the axis 806 indicating the output stroke of the single cycle of the direct injection fuel pump according to the conventional example includes a first ramp portion 809, a second ramp portion 813, and a flat, central portion 811. The first ramp portion 809 corresponds to increasing velocity of the plunger in the direction toward TDC, the second ramp portion 813 corresponds to decreasing velocity of the plunger in the direction toward TDC, and the central portion 811 corresponds to constant velocity of the plunger in the direction toward TDC for cam angles between the first ramp portion 809 and the second ramp portion 813. A length 840 (e.g., duration) of the first ramp portion 809 is shown, where the length 840 of the first ramp portion 809 is smaller than (e.g., a shorter duration corresponding to a smaller amount of cam rotation), or approximately the same as, a length 842 of the end ramp portion 813 between axis 830 and axis 844.

The first ramp portion 809 is shown approximately parallel with axis 812, the second ramp portion 813 is shown approximately parallel with axis 814, and the central portion 811 is shown parallel with axis 810. The axis 810 is parallel with the horizontal axis of chart 800, and as such, the central portion 811 indicates a condition of constant velocity of the plunger with respect to cam angle. For example, the axis 810 is shown arranged at a first angle 816 relative to the axis 812, and the axis 810 is shown arranged at a second angle 818 relative to the axis 814, where the first angle 816 and second angle 818 are approximately a same amount of angle (e.g., the axis 812 is approximately symmetric to the axis 814). A length 826 of the central portion 811 is shown between vertical axis 828 and vertical axis 830 (where the vertical axis 828 and vertical axis 830 are parallel to the vertical axis of chart 800 indicating plunger velocity), where the length 826 indicates an amount of cam angle (e.g., cam rotation)

through which the portion of the output stroke indicated by the central portion 811 occurs.

Referring to FIG. 9, a chart 900 includes plot 702 shown by FIG. 7 and described above, as well as plot 802 shown by FIG. 8 and described above. Plot 702 and plot 802 are included by chart 900 for purposes of comparison. Chart 900 includes axis 704, axis 706, axis 708, axis 712, axis 714, marker 720, marker 722, vertical axis 726, and vertical axis 728 described above with reference to FIG. 7 and shown in the same arrangement as FIG. 7. Chart 900 additionally includes axis 804, axis 806, axis 810, axis 812, axis 814, vertical axis 828, vertical axis 830, marker 822, and marker 822 described above with reference to FIG. 8 and shown in the same arrangement as FIG. 8.

Similar to the comparison between plot 402 and plot 502 described above with reference to FIG. 6, the plot 702 and plot 802 are shown offset from each other (e.g., out-of-phase relative to each other) by FIG. 9. For example, vertical axis 704 and vertical axis 804 are offset from each other by length 908, where vertical axis 704 intersects the marker 720 indicating the cam angle at which the plunger velocity represented by plot 702 changes direction according to the present disclosure, and vertical axis 804 intersects the marker 820 indicating the cam angle at which the plunger velocity represented by plot 802 changes direction according to the conventional example.

Chart 900 additionally illustrates the length 730 of the main portion 711 of the plot 702 and the length 826 of the central portion 811 of the plot 802 for relative comparison. As shown, the length 730 is a greater amount of length (e.g., corresponding to a larger amount of cam angle or cam rotation) than the length 826. Further, the main portion 711 of plot 702 is shown angled relative to the central portion 811 of plot 802, as indicated by angle 902 between axis 810 parallel to central portion 811 and axis 712 parallel to main portion 711. The larger length 730 of plot 702 and the angle 902 of main portion 711 relative to central portion 811 of the conventional example the results in a more gradual decrease in plunger velocity during the output stroke according to the present disclosure (e.g., as represented by plot 702). As another example, chart 900 illustrates length 906 of the end ramp portion 713 of the plot 702 as well as length 904 of the second ramp portion 813 of the plot 802. The length 906 is a smaller amount of length than the length 904 as a result of the angle of main portion 711 of plot 702, whereas the central portion 811 of plot 802 is not angled (e.g., central portion 811 extends parallel with the horizontal axis, indicating constant velocity). The more gradual decrease in plunger velocity as represented by plot 702 according to the present disclosure may result in decreased plunger velocity as the solenoid is energized at lower engine speeds (e.g., lower engine speeds, such as idling speeds between 600 and 1000 RPM), which may reduce noise generated by the fuel pump.

For example, at higher engine speeds (e.g., 5000 RPM), energization of the solenoid of the fuel pump may occur earlier in the output stroke (e.g., at a cam angle of approximately 55 degrees), and at lower engine speeds (e.g., 1000 RPM), energization of the solenoid of the fuel pump may occur later in the output stroke (e.g., at a cam angle of approximately 75 degrees). Energizing the solenoid earlier in the output stroke may result in a larger volume of fuel flowing to the fuel rail (e.g., to accommodate the higher engine load) relative to energizing the solenoid later in the output stroke. While the higher engine speeds may result in an increased overall noise of the engine which may obfuscate the noise of the fuel pump, at lower engine speeds, the noise of the fuel pump may be more noticeable. However, by configuring the velocity of the plunger to be lower at the cam angles associated with the later solenoid energization timing of the lower engine speeds, the resulting noise of the fuel pump is reduced, and operator comfort may be increased.

Referring to FIG. 10, a chart 1000 including plot 1002 and plot 1004 illustrates a plunger speed versus cam angle relationship for the cam of the direct injection fuel pump of the vehicle fuel system described above with reference to FIG. 4 and FIG. 7 according to the present disclosure. The plot 1002 corresponds to the intake stroke of the direct injection fuel pump, and the plot 1004 corresponds to the output stroke of the same cycle of the direct injection fuel pump, where the plot 1002 and plot 1004 are not symmetric to each other.

The speed of the flow of fuel into the fuel pump and output by the fuel pump is a function of the plunger speed and cam angle. For example, during conditions in which the plunger moves at a higher speeds during the output stroke of the fuel pump, the flow speed of fuel output by the fuel pump may be relatively high (e.g. to return to the fuel passage and/or flow to the fuel rail), and during conditions in which the plunger moves at a lower speeds during the output stroke, the flow speed of fuel output by the fuel pump may be relatively lower. As one example, the flow speed of fuel output by the fuel pump (e.g., to the fuel rail and/or the fuel passage fluidly coupled to the inlet of the fuel pump, depending on whether the solenoid valve of the fuel pump is energized or de-energized) may be higher during the main portion 1005 of the output stroke compared to the flow speed during the end ramp portion 1009 of the output stroke.

The plot 1004 shows the plunger speed versus cam angle relationship independent of engine speed. In particular, as the operating speed of the engine changes (e.g., increases or decreases), the plunger speed versus cam angle relationship shown by plot 1004 does not change. Although the cam may be driven (e.g., rotate) more quickly at higher engine speeds due to the camshaft being driven (e.g., rotated) more quickly by the engine, the plunger speed correspondingly changes with the cam rotation speed (e.g., cam rotation rate) such that the plunger speed versus cam angle relationship shown by plot 1004 is maintained (e.g., the same) for each different engine speed. As one example operation of the direct injection fuel pump, the drive speed of the direct injection fuel pump may be maintained (e.g., the cam may rotate at a constant speed to drive the plunger of the fuel pump) while the flow speed of the total flow of fuel from the direct injection fuel pump is continuously reduced for at least half of the total duration (e.g., total length 1013) of the output stroke. In particular, the flow speed of the total flow of fuel from the direct injection fuel pump is decreased at a first rate at the main portion 1005 (e.g., as the plunger velocity decreases at the first rate), and the flow speed of the total flow of fuel from the direct injection fuel pump is decreased at a second rate at the end ramp portion 1009 (e.g., as the plunger velocity decreases at the second rate). The second rate is greater than the first rate, as indicated by axis 1014 relative to axis 1012 (e.g., where the axis 1014 aligned at the end ramp portion 1009 is more steeply angled relative to the axis 1012 aligned at the main portion 1005, with the axis 1012 and axis 1014 in a same relative arrangement as the axis 712 and axis 714 shown by FIG. 7 and described above).

Marker 1008 indicates the cam angle at which the plunger is at the TDC position of the intake stroke, marker 1006 indicates the cam angle at which the plunger is at the BDC position at the end of the intake stroke and the start of the output stroke, and marker 1010 indicates the cam angle at which the plunger is at the TDC position at the end of the output stroke. With reference to FIG. 7, the portion of plot 702 shown vertically below the axis 706 is represented by the plot 1002 of chart 1000, and the portion of plot 702 shown vertically above the axis 706 is represented by the plot 1004 of chart 1000. For example, plot 1002 illustrates the plunger speed versus cam angle relationship according to the present disclosure without showing the movement direction of the plunger, whereas plot 702 of FIG. 7 additionally illustrates the movement direction of the plunger via the directional component of the velocity (e.g., whether portions of the plot 702 are shown vertically above or below the axis 706). As such, several of the axes and other elements shown by chart 1000 are in a relative arrangement that is the same as the arrangement of the axes and other elements shown by FIGS. 7 and 9 and described above. For example, chart 1000 includes axis 1007, axis 1012, and axis 1014, similar to the axis 708, axis 712, and axis 714, respectively, and in the same relative arrangement as the axis 708, axis 712, and axis 714 described above with reference to FIGS. 7 and 9. Chart 1000 additionally includes axis 1020, axis 1022, axis 1024, axis 1033, axis 1026, length 1028, length 1030, length 1032, and length 1037, similar to the axis 704, axis 726, axis 728, axis 733, axis 744, length 740, length 730, length 742, and length 737, respectively, described above.

Chart 1000 shows a length 1056 of a intake portion 1055 of the intake stroke, with the length 1056 arranged between vertical axis 1052 and vertical axis 1054. A total length 1058 of the intake stroke is shown between vertical axis 1050 and vertical axis 1020, where the total length 1058 of the intake portion is less than a total length 1013 of the output stroke (e.g., a combination of length 1028, length 1030, and length 1032). Further, a combination of the length 1030 and the length 1032 (e.g., the combined length of length 1030 and length 1032) is greater than half of the total length 1013 of the output stroke (as described above with reference to FIG. 7 with regard to length 730, length 742, and total length 743). The plunger speed at the intake portion 1055 of the intake stroke is larger than the plunger speed at the main portion 1005 at the output stroke. In particular, because the plunger speed at the intake portion 1055 does not decrease at a constant rate, and the plunger speed at the main portion 1005 decreases at the first constant rate, and because the flow speed of the total flow of fuel through the direct injection fuel pump is based on the plunger speed (e.g., decreasing as a result of decreasing plunger speed and increasing as a result of increasing plunger speed), the flow speed of the total flow of fuel throughout the intake portion 1055 is higher than the flow speed of the total flow of fuel throughout the main portion 1005. Because chart 700 shown by FIG. 7 illustrates the plunger velocity versus cam angle relationship and the chart 1000 illustrates the plunger speed versus cam angle relationship, the total length 743 of the output stroke shown by FIG. 7 is the same as the total length 1013 of the output stroke shown by FIG. 10. The length 1028, length 1030, and length 1032 shown by FIG. 10 are the same as the length 740, length 730, and length 742, respectively, shown by FIG. 7.

Referring to FIG. 11, a chart 1100 including plot 1102 and plot 1104 illustrates a plunger speed versus cam angle relationship for the conventional example of the cam of the direct injection fuel pump of the vehicle fuel system described above with reference to FIG. 5 and FIG. 8. The plot 1102 corresponds to the intake stroke of the direct injection fuel pump, and the plot 1104 corresponds to the output stroke of the same cycle of the direct injection fuel pump, where the plot 1102 and plot 1104 are symmetric to each other. Marker 1108 indicates the cam angle at which the plunger is in the TDC position of the intake stroke according to the conventional example, marker 1106 indicates the cam angle at which the plunger is at the BDC position of the end of the intake stroke and the start of the output stroke according to the conventional example, and marker 1110 indicates the cam angle at which the plunger is at the TDC position at the end of the output stroke according to the conventional example. With reference to FIG. 8, the portion of plot 802 shown vertically below the axis 806 is represented by the plot 1102 of chart 1100, and the portion of plot 802 shown vertically above the axis 806 is represented by the plot 1104 of chart 1100. For example, plot 1104 illustrates the plunger speed versus cam angle relationship according to the conventional example without showing the movement direction of the plunger, whereas plot 802 of FIG. 8 additionally illustrates the movement direction of the plunger via the directional component of the velocity (e.g., whether portions of the plot 802 are shown vertically above or below the axis 806). Several of the axes shown by chart 1100 are in a relative arrangement that is the same as the arrangement of the axes shown by FIGS. 8 and 9 and described above. For example, chart 1100 includes axis 1111, axis 1112, and axis 1114, similar to the axis 810, axis 812, and axis 814, respectively, and in the same relative arrangement as the axis 810, axis 812, and axis 814 described above with reference to FIGS. 8 and 9. Chart 1100 additionally includes axis 1120, axis 1122, axis 1124, axis 1126, length 1128, length 1130, and length 1132, similar to the axis 804, axis 828, axis 830, axis 844, length 840, length 826, and length 830, respectively, described above.

Chart 1100 shows a length 1150 of a intake portion 1160 of the intake stroke, with the length 1050 arranged between vertical axis 1156 and vertical axis 1158. A total length 1152 of the intake stroke is shown between vertical axis 1154 and vertical axis 1120, where the total length 1152 of the intake portion is approximately a same amount of length as a total length of the output stroke (e.g., a combination of length 1128, length 1130, and length 1132).

Referring to FIG. 12, a chart 1200 includes plot 1002 and plot 1004 shown by FIG. 10 and described above, as well as plot 1102 and plot 1104 shown by FIG. 11 and described above. Plot 1002 and plot 1004 according to the present disclosure and plot 1102 and plot 1104 of the conventional example are included by chart 1200 for purposes of comparison. Chart 1200 includes marker 1006, marker 1008, marker 1010, axis 1007, axis 1012, and axis 1014 described above with reference to FIG. 10 and shown in the same arrangement as FIG. 10. Chart 1200 additionally includes marker 1106, marker 1108, marker 1110, axis 1111, axis 1112, and axis 1114 described above with reference to FIG. 11 and shown in the same arrangement as FIG. 11. As described above, the plunger speed according to the present disclosure decreases during the main portion and the end ramp portion of the output stroke, whereas the plunger speed remains constant (e.g., not decreasing) during the main portion of the conventional example.

In this way, by configuring the direct injection fuel pump to operate with the decreasing plunger speed during the main portion and the end ramp portion, energization of the solenoid valve may occur while the plunger speed is reduced at lower engine speeds. As a result, abrupt changes to fuel pressure within the fuel pump may be reduced relative to examples in which the plunger speed is not reduced, and a noise, vibration, and/or harshness associated with operation of the fuel pump may be decreased, which may increase operator comfort.

The technical effect of decreasing the plunger speed of the direct injection fuel pump during the output stroke is to reduce noise resulting from abrupt changes to fuel pressure within the direct injection fuel pump as the solenoid valve is adjusted from the de-energized condition to the energized condition.

In one embodiment, a method comprises: during an output stroke of a cam-driven direct injection fuel pump of an engine, maintaining a drive speed of the cam-driven direct injection fuel pump while continuously reducing a flow speed of a total flow of fuel from the cam-driven direct injection fuel pump for at least half of a total duration of the output stroke. In a first example of the method, continuously reducing the flow speed of the total flow of fuel includes reducing the flow speed at a first constant rate during a main portion of the output stroke and transitioning to reducing the flow speed at a second constant rate during an end ramp portion of the output stroke. A second example of the method optionally includes the first example, and further includes wherein the output stroke includes a beginning ramp portion, with the main portion occurring between the beginning ramp portion and the end ramp portion, and with a duration of the beginning ramp portion being longer than a duration of the end ramp portion. A third example of the method optionally includes one or both of the first and second examples, and further includes wherein a magnitude of the second constant rate is greater than a magnitude of the first constant rate, and wherein transitioning to reducing the flow speed at the second constant rate includes reducing the flow speed at a non-constant rate through an end transition portion between the main portion and the end ramp portion. A fourth example of the method optionally includes one or more or each of the first through third examples, and further includes increasing the flow speed of the total flow of fuel from the cam-driven direct injection fuel pump during the output stroke at the beginning ramp portion. A fifth example of the method optionally includes one or more or each of the first through fourth examples, and further includes directly transitioning from increasing the flow speed of the total flow of fuel from the cam-driven direct injection fuel pump during the output stroke at the beginning ramp portion to reducing the flow speed at the first constant rate during the main portion. A sixth example of the method optionally includes one or more or each of the first through fifth examples, and further includes flowing the fuel to the cam-driven direct injection pump during an intake stroke of a single cycle of the cam-driven direct injection fuel pump, where the single cycle includes only the intake stroke and the output stroke and the total duration of the output stroke is longer than a total duration of the intake stroke. A seventh example of the method optionally includes one or more or each of the first through sixth examples, and further includes wherein the flow speed of the total flow of fuel from the cam-driven direct injection fuel pump during a main portion of the output stroke is less than a flow speed of the fuel flowing to the cam-driven direct injection fuel pump during a intake portion of the intake stroke. An eighth example of the method optionally includes one or more or each of the first through seventh examples, and further includes directing the total flow of fuel from the cam-driven direct injection fuel pump to a fuel rail of the engine for at least a portion of the total duration of the output stroke. A ninth example of the method optionally includes one or more or each of the first through eighth examples, and further includes wherein directing the total flow of fuel from the cam-driven direct injection fuel pump to the fuel rail includes energizing a solenoid of the cam-driven direct injection fuel pump throughout the portion of the total duration of the output stroke, where a length of the portion of the total duration is based on the flow speed of the fuel.

In another embodiment, a method comprises: driving a plunger of a direct injection fuel pump of an engine via a cam of a camshaft; and while driving the plunger during an output stroke of the direct injection fuel pump, reducing a speed of the plunger at both of a main portion and an end ramp portion of the output stroke while maintaining a rotation rate of the cam. In a first example of the method, reducing the speed of the plunger at both of the main portion and the end ramp portion includes reducing a total flow rate of fuel from the direct injection fuel pump. A second example of the method optionally includes the first example, and further includes controlling an energization timing of a solenoid valve of the direct injection fuel pump based on the speed of the plunger. A third example of the method optionally includes one or both of the first and second examples, and further includes wherein controlling the energization timing includes adjusting a duty cycle of the solenoid valve. A fourth example of the method optionally includes one or more or each of the first through third examples, and further includes wherein the output stroke occurs entirely during rotation of the cam through a first amount of angle, and the main portion and the end ramp portion occur through at least half of the rotation of the cam through the first amount of angle. A fifth example of the method optionally includes one or more or each of the first through fourth examples, and further includes wherein the main portion occurs throughout rotation of the cam through a second amount of angle and the end ramp portion occurs throughout rotation of the cam through a third amount of angle, with the second amount of angle and the third amount of angle each being portions of the first amount of angle, and with the third amount of angle being less than the second amount of angle. A sixth example of the method optionally includes one or more or each of the first through fifth examples, and further includes wherein reducing the speed of the plunger at both of the main portion and the end ramp portion of the output stroke while maintaining the rotation rate of the cam includes reducing the speed by a first amount throughout the main portion and reducing the speed by a second amount at the end ramp portion.

In one embodiment, a system comprises: a direct injection fuel pump including a solenoid valve; a cam driven by a camshaft and engaged with a plunger of the direct injection fuel pump; a fuel rail fluidly coupling the direct injection fuel pump to a fuel injector; and a controller including instructions stored in non-transitory memory that when executed, cause the controller to: adjust a duty cycle of the solenoid valve responsive to a speed of the plunger while the plunger is driven by a rotation of the cam and the speed of the plunger decreases for at least half of each output stroke of the direct injection fuel pump. In a first example of the system, the system further comprises instructions stored in the non-transitory memory of the controller that when executed, cause the controller to: responsive to increasing engine speed, increase the duty cycle of the solenoid valve while the speed of the plunger decreases; and responsive to decreasing engine speed, decrease the duty cycle of the solenoid valve while the speed of the plunger decreases. In a second example of the system, the system further comprises instructions stored in the non-transitory memory of the controller that when executed, cause the controller to:

maintain a rotational speed of the cam while adjusting the duty cycle of the solenoid valve responsive to the speed of the plunger as the speed of the plunger decreases for at least half of each output stroke of the direct injection fuel pump.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

flowing fuel to a cam-driven direct injection fuel pump of an engine during an intake stroke of a single cycle of the cam-driven direct injection fuel pump, where the single cycle includes only the intake stroke and an output stroke and a total duration of the output stroke is longer than a total duration of the intake stroke;

transitioning the cam-driven direct injection fuel pump from the intake stroke to the output stroke; and during the output stroke, maintaining a drive speed of the cam-driven direct injection fuel pump while continuously reducing a flow speed of a total flow of fuel from the cam-driven direct injection fuel pump for at least half of the total duration of the output stroke, wherein continuously reducing the flow speed of the total flow of fuel includes:

reducing the flow speed at a first constant rate throughout a main portion of the output stroke; and reducing the flow speed at a second constant rate throughout an end ramp portion of the output stroke following the main portion, where the end ramp portion is offset from the transition of the cam-driven direct injection fuel pump from the intake stroke to the output stroke by less than half of a total duration of the single cycle.

2. The method of claim 1, wherein the output stroke includes a beginning ramp portion, with the main portion occurring between the beginning ramp portion and the end ramp portion, and with a duration of the beginning ramp portion being longer than a duration of the end ramp portion.

3. The method of claim 2, wherein a magnitude of the second constant rate is greater than a magnitude of the first constant rate, and wherein transitioning the flow speed from the first constant rate to the second constant rate includes reducing the flow speed at a non-constant rate through an end transition portion between the main portion and the end ramp portion.

4. The method of claim 3, further comprising increasing the flow speed of the total flow of fuel from the cam-driven direct injection fuel pump during the output stroke at the beginning ramp portion.

5. The method of claim 4, further comprising directly transitioning from increasing the flow speed of the total flow of fuel from the cam-driven direct injection fuel pump during the output stroke at the beginning ramp portion to reducing the flow speed at the first constant rate during the main portion.

6. The method of claim 1, wherein the flow speed of the total flow of fuel from the cam-driven direct injection fuel pump during the main portion of the output stroke is less than a flow speed of the fuel flowing to the cam-driven direct injection fuel pump during the intake stroke.

7. The method of claim 1, further comprising directing the total flow of fuel from the cam-driven direct injection fuel pump to a fuel rail of the engine for at least a portion of the total duration of the output stroke.

8. The method of claim 7, wherein directing the total flow of fuel from the cam-driven direct injection fuel pump to the fuel rail includes energizing a solenoid of the cam-driven direct injection fuel pump throughout the portion of the total duration of the output stroke, where a length of the portion of the total duration is based on the flow speed of the fuel.

9. The method of claim 1, wherein a duration of the intake stroke is greater than the offset of the end ramp portion from the transition of the cam-driven direct injection fuel pump from the intake stroke to the output stroke.

* * * * *